US007071669B2

(12) United States Patent
Morita

(10) Patent No.: US 7,071,669 B2
(45) **Date of Patent: *Jul. 4, 2006**

(54) REFERENCE VOLTAGE GENERATION CIRCUIT, DISPLAY DRIVER CIRCUIT, DISPLAY DEVICE, AND METHOD OF GENERATING REFERENCE VOLTAGE

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 511 days.

This patent is subject to a terminal disclaimer.

(21) Appl. No.: 10/355,298

(22) Filed: Jan. 31, 2003

(65) Prior Publication Data

US 2003/0151578 A1 Aug. 14, 2003

(30) Foreign Application Priority Data

Feb. 8, 2002 (JP) ..... 2002-032677

(51) Int. Cl.
*G05F 3/16* (2006.01)

(52) U.S. Cl. ..... 323/297; 323/313; 323/354

(58) Field of Classification Search ..... 323/297, 323/298, 313, 353, 354, 369
See application file for complete search history.

(56) References Cited

U.S. PATENT DOCUMENTS 4,364,006 A * 12/1982 Makabe et al. ..... 323/353
5,717,323 A * 2/1998 Tailliet ..... 323/297
5,745,092 A 4/1998 Ito ..... 345/95
5,814,981 A * 9/1998 Tsuchi et al. ..... 323/369
5,859,633 A 1/1999 Kim ..... 345/211
5,867,057 A 2/1999 Hsu et al. ..... 327/544

(Continued)

FOREIGN PATENT DOCUMENTS

EP 1 014 333 A1 6/2000

(Continued)

OTHER PUBLICATIONS

Furuhashi et al., "A 64-Gray-Scale Digital Signal Driver for Color TFT-LCDS", SID International Symposium Digest of Technical Papers. San Jose, Jun. 14-16, 1994, Santa Ana, SID, US, vol. 25, Jun. 14, 1994, pp. 359-362.

(Continued)

*Primary Examiner*—Jeffrey Sterrett
(74) *Attorney, Agent, or Firm*—Oliff & Berridge, PLC

(57) ABSTRACT

A reference voltage generation circuit includes first to third resistance ladder circuits. The first resistance ladder circuit has at least one variable resistance circuit in which a resistance value between both ends is variable, and outputs multi-valued reference voltages. The second resistance ladder circuit has series-connected resistance circuits each of which has a fixed resistance value, and outputs a plurality of reference voltages. The third resistance ladder circuit has at least one variable resistance circuit in which a resistance value between both ends is variable, and outputs multi-valued reference voltages. The first to third resistance ladder circuits are connected in series between first and second power supply lines. The resistance values of the variable resistance circuits in the first and third resistance ladder circuits are variably controlled by a given command or a variable control signal input through an external input terminal.

15 Claims, 21 Drawing Sheets

U.S. PATENT DOCUMENTS

| | | | | |
|---|---|---|---|---|
| 6,275,207 | B1 | 8/2001 | Nitta et al. | 345/89 |
| 6,331,768 | B1 * | 12/2001 | Drori et al. | 323/369 |
| 6,498,469 | B1 * | 12/2002 | Kobayashi | 323/313 |
| 6,552,519 | B1 * | 4/2003 | Nazarian | 323/354 |
| 6,744,244 | B1 * | 6/2004 | Liu et al. | 323/354 |
| 6,888,526 | B1 * | 5/2005 | Morita | 345/95 |

FOREIGN PATENT DOCUMENTS

| | | |
|---|---|---|
| EP | 1 094 440 A2 | 4/2001 |
| JP | A 05-035211 | 2/1993 |
| JP | A 08-327974 | 12/1996 |
| JP | A 11-202299 | 7/1999 |

OTHER PUBLICATIONS

U.S. Appl. No. 10/348,944, filed Jan. 23, 2003, Morita.
U.S. Appl. No. 10/349,091, filed Jan. 23, 2003, Morita.
U.S. Appl. No. 10/354,999, filed Jan. 31, 2003, Morita.

* cited by examiner

RELATIONSHIP BETWEEN GRAYSCALE VALUE AND RESISTANCE VALUE RATIO

REFERENCE VOLTAGE GENERATION CIRCUIT, DISPLAY DRIVER CIRCUIT, DISPLAY DEVICE, AND METHOD OF GENERATING REFERENCE VOLTAGE

Japanese Patent Application No. 2002-32677, filed on Feb. 8, 2002, is hereby incorporated by reference in its entirety.

BACKGROUND OF THE INVENTION

The present invention relates to a reference voltage generation circuit, a display driver circuit, a display device, and a method of generating a reference voltage.

A decrease in size and an increase in resolution have been demanded for a display device represented by an electro-optical device such as a liquid crystal device. In particular, a liquid crystal device realizes a decrease in power consumption and has been generally used for portable electronic equipment. In the case where a liquid crystal device is used as a display section of a portable telephone, image display with a rich color tone due to an increase in the number of grayscale levels is required.

BRIEF SUMMARY OF THE INVENTION

According to one aspect of the present invention, there is provided a reference voltage generation circuit which generates multi-valued reference voltages for generating a gamma-corrected grayscale value based on grayscale data, the reference voltage generation circuit comprising:

a first resistance ladder circuit having at least one variable resistance circuit in which a resistance value between both ends is variable, and outputting multi-valued voltages;

a second resistance ladder circuit in which a plurality of resistance circuits each having a fixed resistance value are connected in series, outputting a plurality of voltages; and a third resistance ladder circuit having at least one variable resistance circuit in which a resistance value between both ends is variable, and outputting multi-valued voltages, wherein the first to third resistance ladder circuits are connected in series between first and second power supply lines to which first and second power supply voltages are respectively supplied; and wherein the resistance values of the variable resistance circuits in the first and third resistance ladder circuits are variably controlled according to a given command setting or a given variable control signal.

According to another aspect of the present invention, there is provided a method of generating multi-valued reference voltages for generating a gamma-corrected grayscale value based on grayscale data, the method comprising:

providing first to third resistance ladder circuits series-connected between first and second power supply lines to which first and second power supply voltages are respectively supplied;

fixing a resistance value of the second resistance ladder circuit; and variably controlling resistance values of resistance circuits forming the first and third resistance ladder circuits, according to a given command or a variable control signal.

DETAILED DESCRIPTION OF THE EMBODIMENT

Figure 1:
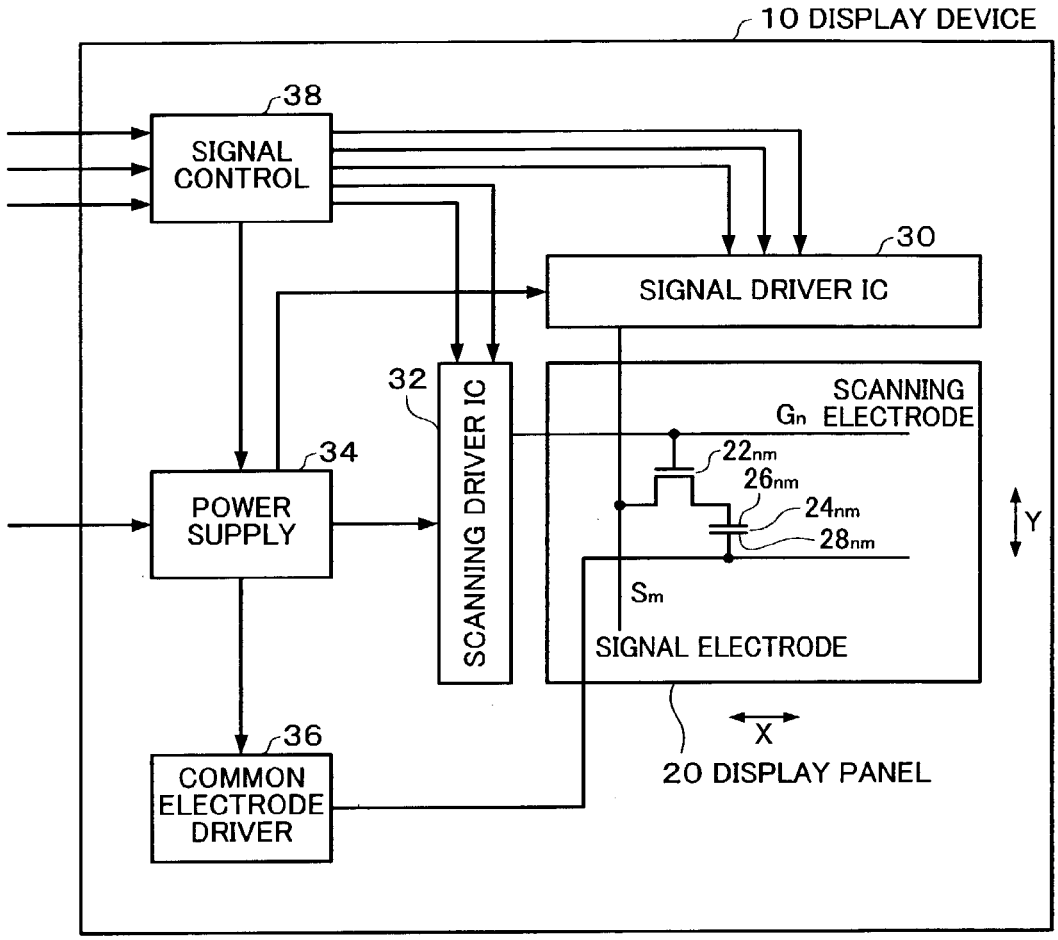
FIG. 1 is a block diagram showing a display device to which a display driver circuit including a reference voltage generation circuit according to one embodiment of the present invention is applied.

Embodiments of the present invention are described below. Note that the embodiments described below do not in any way limit the scope of the invention defined by the claims laid out herein. Similarly, all the elements of the embodiments described below should not be taken as essential requirements of the present invention.

Generally, an image signal for image display is gamma-corrected according to display characteristics of the display device. The gamma correction is performed by a gamma correction circuit (or a reference voltage generation circuit in a broad sense). Taking a liquid crystal device as an example, the gamma correction circuit generates a voltage corresponding to the pixel transmittance, based on grayscale data for performing grayscale display.

The gamma correction circuit is included in a display driver circuit which drives a display device. Therefore, a display driver circuit used in electronic equipment for which downsizing is demanded is preferably small. So that the gamma correction circuit is adjusted to perform gamma correction specified for display characteristics of the display device to be driven, and a multi-purpose display driver circuit which is widely used irrespective of the type of display device cannot be provided.

The following embodiments may provide a reference voltage generation circuit, a display driver circuit, a display device, and a method of generating a reference voltage which can be multi-purposely used without increasing the circuit size, irrespective of the type of display device.

According to one embodiment of the present invention, there is provided a reference voltage generation circuit which generates multi-valued reference voltages for generating a gamma-corrected grayscale value based on grayscale data, the reference voltage generation circuit comprising:

a first resistance ladder circuit having at least one variable resistance circuit in which a resistance value between both ends is variable, and outputting multi-valued voltages;

a second resistance ladder circuit in which a plurality of resistance circuits each having a fixed resistance value are connected in series, outputting a plurality of voltages; and a third resistance ladder circuit having at least one variable resistance circuit in which a resistance value between both ends is variable, and outputting multi-valued voltages, wherein the first to third resistance ladder circuits are connected in series between first and second power supply lines to which first and second power supply voltages are respectively supplied; and wherein the resistance values of the variable resistance circuits in the first and third resistance ladder circuits are variably controlled according to a given command setting or a given variable control signal.

In this embodiment, the first to third resistance ladder circuits are connected in series between the first and second power supply lines, and the multi-valued reference voltages are output from each of the resistance ladder circuits. Each of the first and third resistance ladder circuits includes at least one variable resistance circuit in which the resistance value between both ends is variable, and the second resistance ladder circuit is formed by connecting the resistance circuits having a fixed resistance value in series. The first and third resistance ladder circuits are variably controlled by a given command from a user or a given variable control signal, for example. The resistance value of the second resistance ladder circuit is not changed by the command or the variable control signal.

The first and third resistance ladder circuits may be variably controlled by the same command or the same variable control signal, or by different commands or different variable control signals.

In a display panel, in particular a liquid crystal panel, the reference voltage for performing optimum grayscale display depends on a liquid crystal material or the like. Therefore, the resistance ratio of the resistance ladder must be optimized according to the type of display panel. However, the resistance ratio of the resistance ladder is substantially constant in a halftone region irrespective of the type of display panel. According to this embodiment of the invention, the resistance ratio can be changed according to the type of display panel by variably controlling only the resistance values of the first and third resistance ladder circuits using a command or a variable control signal. So that the reference voltages which are gamma-corrected for performing optimum grayscale display can be generated irrespective of the type of display panel, while minimizing an increase in circuit size due to variable control.

At least one of the variable resistance circuits of the first and third resistance ladder circuits may include parallel-connected resistance switch circuits, each of the resistance switch circuits having a switch element and a resistance element connected to each other in series.

In this configuration, since the resistance switch circuits each of which has a series-connected switch element and resistance element are connected in parallel, various resistance values can be easily implemented by controlling the switch element. A general-purpose reference voltage generation circuit can be thus provided by a simple configuration.

The variable resistance circuit may further include a resistance element connected in parallel with at least one of the resistance switch circuits.

In this configuration, since a resistance element not connected with the switch element is connected in parallel with at least one of the resistance switch circuits, a control or additional circuit for avoiding an open state caused by erroneous switch control can be simplified.

At least one of the variable resistance circuits of the first and third resistance ladder circuits may further include series-connected resistance switch circuits, each of the resistance switch circuits having a resistance element and a switch element connected to each other in parallel.

In this configuration, since the resistance switch circuits each of which has parallel connected resistance element and switch circuit are series-connected, various resistance values can be easily implemented by controlling the switch element. A general-purpose reference voltage generation circuit can be thus provided by a simple configuration.

At least one of the first and third resistance ladder circuits may have at least two of the variable resistance circuits which are connected to each other in series.

This makes it possible to control the resistance ratio with higher accuracy to provide a general-purpose reference voltage generation circuit.

In this reference voltage generation circuit, the variable resistance circuit in each of the first and third resistance ladder circuits may include:

a resistance element inserted between the i-th divided node (i is a positive integer) for generating the i-th reference voltage and the (i−1)th divided node for outputting the (i−1)th reference voltage among first to R-th reference voltages ($1 \leqq i \leqq R$, R is an integer equal to or larger than 2);

a first operational amplifier circuit which is voltage-follower connected and an input of which is connected to the i-th divided node;

a first switch element inserted between an output node of the i-th reference voltage and an output of the first operational amplifier circuit; and a second switch element inserted between the output node of the i-th reference voltage and the i-th divided node, wherein the first switch element is in the ON state and the second switch element is in the OFF state during a former period in a given drive period, and the first switch element is in the OFF state and the second switch element is in the ON state during a latter period in the drive period; and wherein an operating current of the first operational amplifier circuit is limited or terminated in the latter period of the drive period.

Since a given reference voltage can be rapidly driven by the first operational amplifier circuit and current consumption of the first operational amplifier circuit can be minimized, a reference voltage generation circuit enabling a reduction in power consumption can be provided even if the drive period is shortened.

The reference voltage generation circuit may further comprise:

a second operational amplifier circuit inserted between an output of the first operational amplifier circuit and an output node of the (i+1)th reference voltage, wherein the second operational amplifier circuit outputs a voltage obtained by applying a given offset voltage to the i-th reference voltage in the former period; and wherein an operating current of the second operational amplifier circuit is limited or terminated in the latter period of the drive period.

In this configuration, the first operational amplifier can speed up the rise of the reference voltage for halftone display, for example, and highly accurate drive is enabled by the offset voltage applied by the second operational amplifier. Moreover, current consumption by the second operational amplifier circuit can be minimized.

In this reference voltage generation circuit, each of the first to third resistance ladder circuits may be formed of the first to P-th resistance circuits (P is a positive integer); and in the second resistance ladder circuit, a ratio of a first resistance value of the L-th resistance circuit ($1 \leqq L \leqq P$, L is an integer) when driving a first display panel to a second resistance value of the L-th resistance circuit when driving a second display panel may be equal to or less than 2.

This makes it possible to provide a reference voltage generation circuit which operates not depending on the type of display penal without deteriorating grayscale display.

According to one embodiment of the present invention, there is provided a display driver circuit comprising:

the above-described reference voltage generation circuit;

a voltage select circuit which selects a voltage from among multi-valued reference voltages generated by the reference voltage generation circuit, based on grayscale data; and a signal electrode driver circuit which drives a signal electrode by using the voltage selected by the voltage select circuit.

This makes it possible to provide a display driver circuit including a general-purpose gamma correction circuit, enabling to lower the cost.

The display driver circuit may further comprise an external input terminal through which the variable control signal is input.

This makes it possible to provide a display driver circuit which can be easily adjusted by a user according to the type of the display panel.

According to one embodiment of the present invention, there is provided a display device comprising:

a plurality of signal electrodes;

a plurality of scanning electrodes which intersect the signal electrodes;

pixels specified by the signal electrodes and the scanning electrodes;

the above-described display driver circuit which drives the signal electrodes; and a scanning electrode driver circuit which drives the scanning electrodes.

This makes it possible to provide a display device at low cost by using a general-purpose display driver circuit which operates not depending on the type of display panel.

According to one embodiment of the present invention, there is provided a display device comprising:

a display panel having a plurality of signal electrodes, a plurality of scanning electrodes which intersect the signal electrodes, and pixels specified by the signal electrodes and the scanning electrodes;

the above-described display driver circuit which drives the signal electrodes; and a scanning electrode driver circuit which drives the scanning electrodes.

This makes it possible to provide a display device at low cost by using a general-purpose display driver circuit which operates not depending on the type of display panel.

According to one embodiment of the present invention, there is provided a method of generating multi-valued reference voltages for generating a gamma-corrected grayscale value based on grayscale data, the method comprising:

providing first to third resistance ladder circuits series-connected between first and second power supply lines to which first and second power supply voltages are respectively supplied;

fixing a resistance value of the second resistance ladder circuit; and variably controlling resistance values of resistance circuits forming the first and third resistance ladder circuits, according to a given command or a variable control signal.

According to this method, the resistance ratio can be changed according to the type of display panel by variably controlling only the resistance values of the first and third resistance ladder circuits using a command or a variable control signal. Therefore, a reference voltage gamma-corrected for performing optimum grayscale display can be generated by a simple variable control, irrespective of the type of the display panel.

Embodiments of the present invention are described below in detail with reference to the drawings.

A reference voltage generation circuit in one embodiment of the present invention may be used as a gamma correction circuit. The gamma correction circuit is included in a display driver circuit. The display driver circuit may be used to drive an electro-optical device such as a liquid crystal device having optical characteristics which can be changed by application of voltages.

Although embodiments of the reference voltage generation circuit of the present invention applied to a liquid crystal device will be described below, the present invention is not limited thereto, and it can equally well be applied to other display devices.

1. Display Device

FIG. 1 schematically shows a display device to which a display driver circuit including a reference voltage generation circuit according to one embodiment of the present invention is applied.

A display device (electro-optical device or liquid crystal device in a narrow sense) 10 may include a display panel (liquid crystal panel in a narrow sense) 20.

The display panel 20 is formed on a glass substrate, for example. A plurality of scanning electrodes (gate lines) $G_1$ to $G_N$ (N is an integer equal to or larger than 2) which are arranged in the Y direction and extend in the X direction, and a plurality of signal electrodes (source lines) $S_1$ to $S_M$ (M is an integer equal to or larger than 2) which are arranged in the X direction and extend in the Y direction are disposed on the glass substrate. A pixel region (pixel) is provided corresponding to the intersection point between the scanning electrode $G_n$ ($1 \leqq n \leqq N$, n is an integer) and the signal electrode $S_m$ ($1 \leqq m \leqq M$, m is an integer). A thin film transistor (TFT) $\mathbf{22}_{nm}$ is disposed in the pixel region.

A gate electrode of the TFT $22_{nm}$ is connected with the scanning electrode $G_n$. A source electrode of the TFT $22_{nm}$ is connected with the signal electrode $S_m$. A drain electrode of the TFT $22_{nm}$ is connected with a pixel electrode $26_{nm}$ of a liquid crystal capacitance (liquid crystal element in a broad sense) $24_{nm}$.

The liquid crystal capacitance $24_{nm}$ is formed by sealing a liquid crystal between the pixel electrode $26_{nm}$ and a common electrode $28_{nm}$ opposite thereto. The transmittance of the pixel is changed corresponding to voltage applied between these electrodes. A common electrode voltage Vcom is supplied to the common electrode $28_{nm}$.

The display device 10 may include a signal driver IC 30. The display driver circuit in this embodiment may be used as the signal driver IC 30. The signal driver IC 30 drives the signal electrodes $S_1$ to $S_M$ of the display panel 20 based on image data.

The display device 10 may include a scanning driver IC 32. The scanning driver IC 32 sequentially drives the scanning electrodes $G_1$ to $G_N$ of the display panel 20 in one vertical scanning period.

The display device 10 may include a power supply circuit 34. The power supply circuit 34 generates voltage necessary for driving the signal electrode and supplies the voltage to the signal driver IC 30. The power supply circuit 34 generates voltage necessary for driving the scanning electrode and supplies the voltage to the scanning driver IC 32. The power supply circuit 34 generates the common electrode voltage Vcom.

The display device 10 may include a common electrode driver circuit 36. The common electrode voltage Vcom generated by the power supply circuit 34 is supplied to the common electrode driver circuit 36. The common electrode driver circuit 36 outputs the common electrode voltage Vcom to the common electrode of the display panel 20.

The display device 10 may include a signal control circuit 38. The signal control circuit 38 controls the signal driver IC 30, the scanning driver IC 32, and the power supply circuit 34 according to the contents set by a host such as a central processing unit (or CPU, not shown). For example, the signal control circuit 38 sets the operation mode, or supplies a vertical synchronization signal or a horizontal synchronization signal generated therein to the signal driver IC 30 and the scanning driver IC 32. The signal control circuit 38 controls a polarity inversion timing of the power supply circuit 34.

In FIG. 1, the display device 10 includes the power supply circuit 34, the common electrode driver circuit 36, and the signal control circuit 38. However, at least one of these circuits may be provided outside the display device 10. The display device 10 may include the host.

In FIG. 1, at least either the display driver circuit having a function of the signal driver IC 30 or the scanning electrode driver circuit having a function of the scanning driver IC 32 may be formed on the glass substrate on which the display panel 20 is formed.

In the display device 10 having the above-described configuration, the signal driver IC 30 outputs voltage corresponding to grayscale data to the signal electrode for performing grayscale display based on the grayscale data. The signal driver IC 30 gamma-corrects the voltage to be output to the signal electrode based on the grayscale data. Therefore, the signal driver IC 30 includes a reference voltage generation circuit (or a gamma correction circuit, in a narrow sense) for performing gamma correction.

Generally, grayscale characteristics of the display panel 20 differ depending on the structure of the display panel 20 or a liquid crystal material used therefor. Specifically, the relationship between the voltage which should be applied to the liquid crystal and the transmittance of the pixel does not become uniform. Therefore, gamma correction is performed by the reference voltage generation circuit in order to generate an optimum voltage which should be applied to the liquid crystal corresponding to the grayscale data.

In gamma correction, multi-valued voltages generated by a resistance ladder are corrected in order to optimize the voltage which is selected and output based on the grayscale data. The resistance ratio of the resistance circuits of the resistance ladder is determined so that the voltage specified by the manufacturer or the like of the display panel 20 is generated.

Gamma correction enables the display panel to be driven by using voltage optimum for the display panel to be driven. However, it is necessary to change the voltage generated by the reference voltage generation circuit for each display panel to be driven by changing the resistance ratio of each resistance circuit of the resistance ladder. Therefore, the display driver circuit including the reference voltage generation circuit must be changed depending on the type of display panel to be driven. As a result, the display driver circuit cannot be used irrespective of the type of display panel, whereby a further decrease in cost cannot be achieved.

In one embodiment of the present invention, a reference voltage generation circuit which can be widely used irrespective of the type of display panel to be driven, and a display driver circuit using the same are provided.

The signal driver IC 30 to which the display driver circuit including the above reference voltage generation circuit is applied is described below.

2. Signal Driver IC

Figure 2:
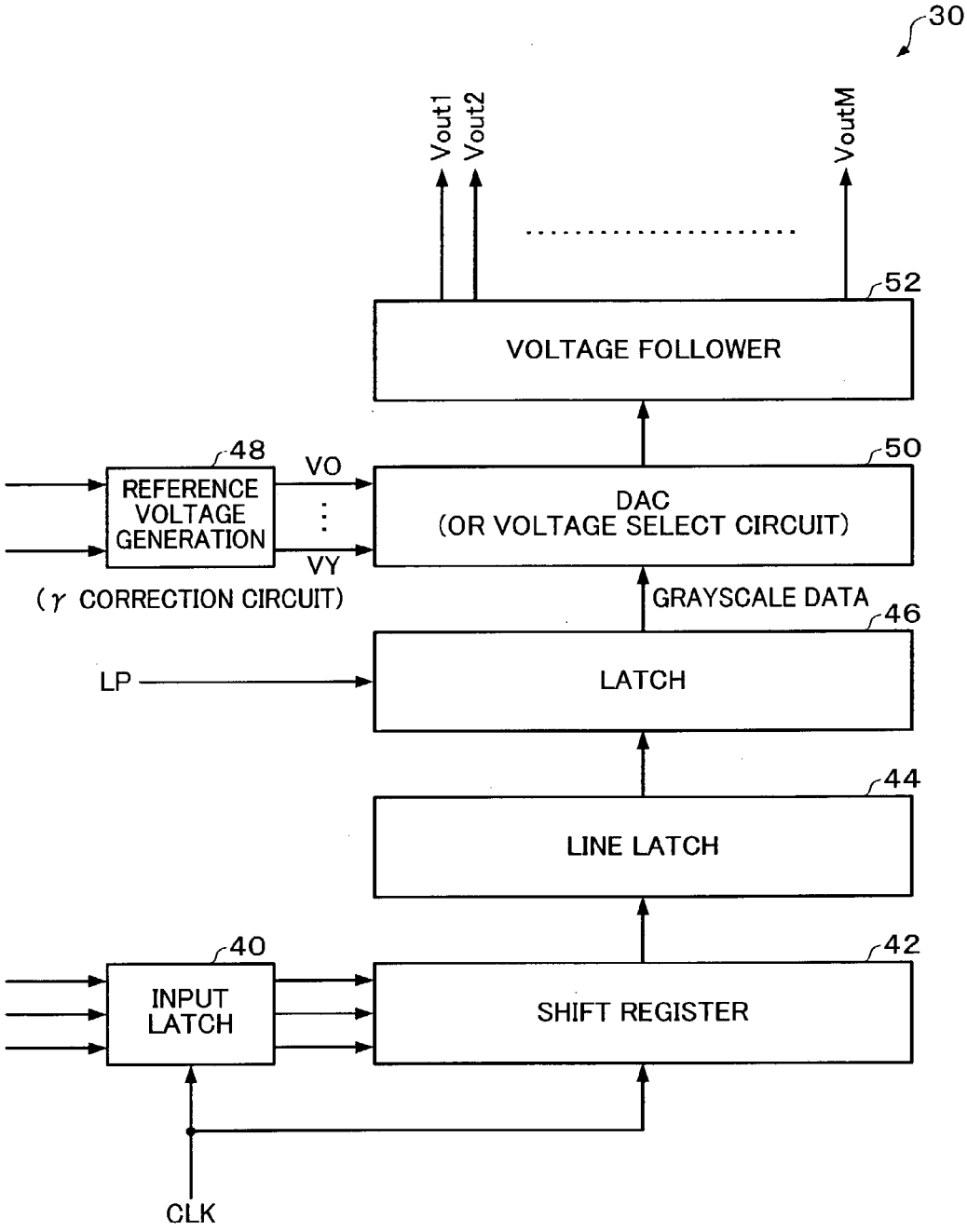
FIG. 2 is a block diagram showing a signal driver IC to which the display driver circuit including the reference voltage generation circuit is applied.

FIG. 2 is a block diagram showing the signal driver IC 30 to which the display driver circuit including the reference voltage generation circuit according to one embodiment of the invention is applied.

The signal driver IC 30 includes an input latch circuit 40, a shift register 42, a line latch circuit 44, a latch circuit 46, a reference voltage generation circuit (or a gamma correction circuit, in a narrow sense) 48, a digital/analog converter (DAC, or a voltage select circuit, in a broad sense) 50, and a voltage follower circuit (or a signal electrode driver circuit, in a broad sense) 52.

The input latch circuit 40 latches the grayscale data consisting of each six bits of RGB signals supplied from the signal control circuit 38 shown in FIG. 1 based on a clock signal CLK, for example. The clock signal CLK is supplied from the signal control circuit 38.

The grayscale data latched by the input latch circuit 40 is sequentially shifted in the shift register 42 based on the clock signal CLK. The grayscale data sequentially shifted in the shift register 42 is captured in the line latch circuit 44.

The grayscale data captured in the line latch circuit 44 is latched by the latch circuit 46 at a timing of a latch pulse signal LP. The latch pulse signal LP is input in a horizontal scanning cycle.

The reference voltage generation circuit 48 outputs multi-valued reference voltages V0 to VY (Y is a positive integer) generated at the divided nodes which are divided by resistance between the power supply voltage (first power supply voltage) V0 on the high potential side and the power supply voltage (second power supply voltage) VSS on the low potential side by using the resistance ratio of the resistance ladder determined so that the grayscale display of the display panel to be driven is optimized.

Figure 3:
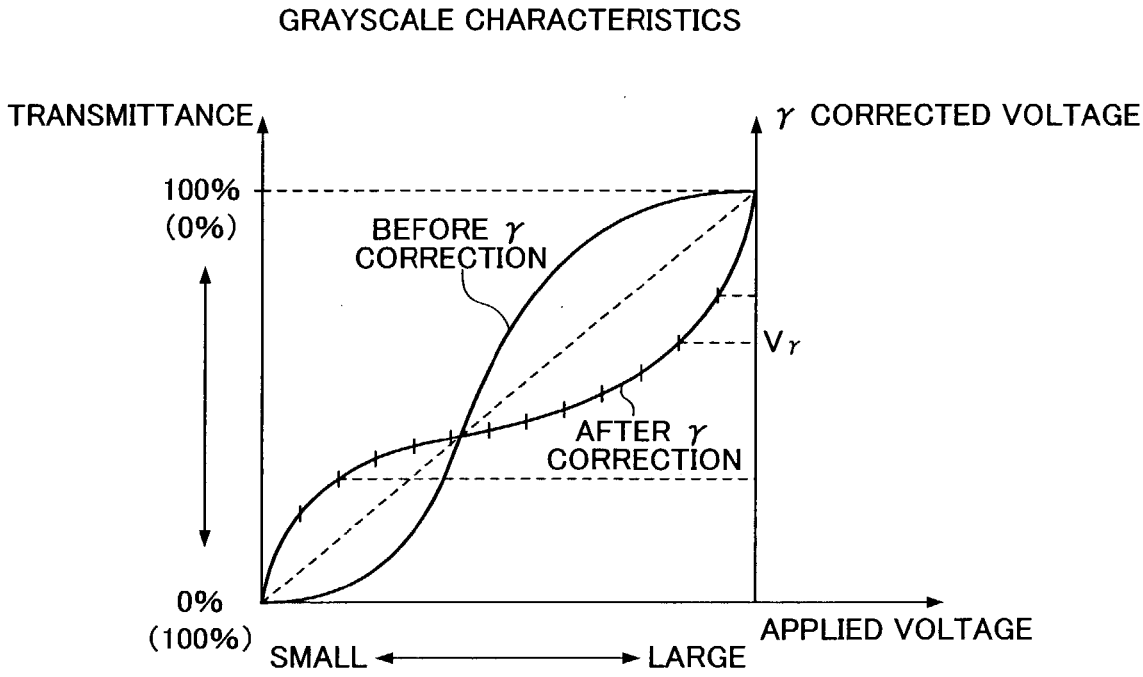
FIG. 3 is a graph illustrating the principle of gamma correction.

FIG. 3 is a graph illustrating the principle of gamma correction.

Grayscale characteristics showing a change in transmittance of the pixel with respect to the voltage applied to the liquid crystal is shown in this figure. If the transmittance of the pixel is indicated by 0% to 100% (or 100% to 0%), the change in transmittance is generally decreased as the voltage applied to the liquid crystal is decreased or increased. The change in transmittance is increased in a region near the middle of the voltage applied to the liquid crystal.

Therefore, transmittance which is gamma-corrected so as to be linearly changed corresponding to the applied voltage can be realized by performing gamma (γ) correction so that the change in transmittance is the reverse of the above-described change in transmittance. Therefore, a reference voltage Vγ which realizes an optimized transmittance can be generated based on the grayscale data as digital data. Specifically, the resistance ratio of the resistance ladder is determined so that such a reference voltage is generated.

The multi-valued reference voltages V0 to VY generated by the reference voltage generation circuit 48 shown in FIG. 2 are supplied to the DAC 50.

The DAC 50 selects one of the multi-valued reference voltages V0 to VY based on the grayscale data supplied from the latch circuit 46, and outputs the selected reference voltage to the voltage follower circuit 52.

The voltage follower circuit 52 performs impedance transformation and drives the signal electrode based on the voltage supplied from the DAC 50.

As described above, the signal driver IC 30 performs impedance transformation by using the voltage selected from the multi-valued reference voltages based on the grayscale data, and outputs the voltage to each signal electrode.

Figure 4:
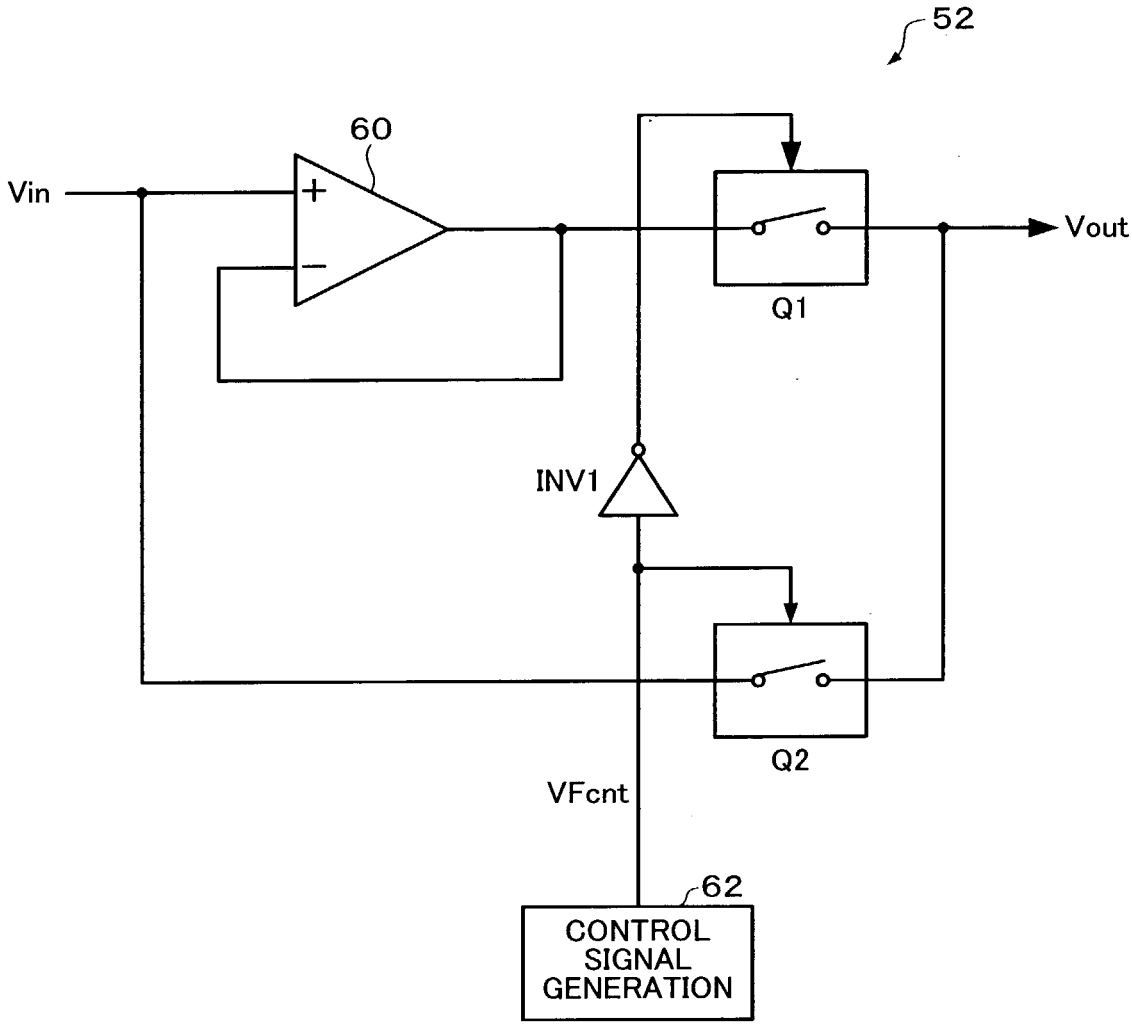
FIG. 4 is a circuit diagram schematically showing a voltage follower circuit.

FIG. 4 schematically shows the voltage follower circuit 52.

Only the configuration for one output is shown in this figure.

The voltage follower circuit 52 includes an operational amplifier 60 and first and second switch elements Q1 and Q2.

The operational amplifier 60 is voltage follower connected. Specifically, an output terminal of the operational amplifier 60 is connected with an inverting input terminal of the operational amplifier 60, whereby negative feedback is formed.

A reference voltage Vin selected by the DAC 50 shown in FIG. 2 is input to a noninverting input terminal of the operational amplifier 60. The output terminal of the operational amplifier 60 is connected with the signal electrode to which a drive voltage Vout is output through the first switch element Q1. The signal electrode is also connected with the noninverting input terminal of the operational amplifier 60 through the second switch element Q2.

A control signal generation circuit 62 generates a control signal VFcnt for ON-OFF controlling the first and second switch elements Q1 and Q2. The control signal generation circuit 62 may be provided for each unit of one or more signal electrodes.

The second switch element Q2 is ON-OFF controlled by the control signal VFcnt. The first switch element Q1 is ON-OFF controlled by an output signal of an inverter circuit INV1 to which the control signal VFcnt is input.

Figure 5:
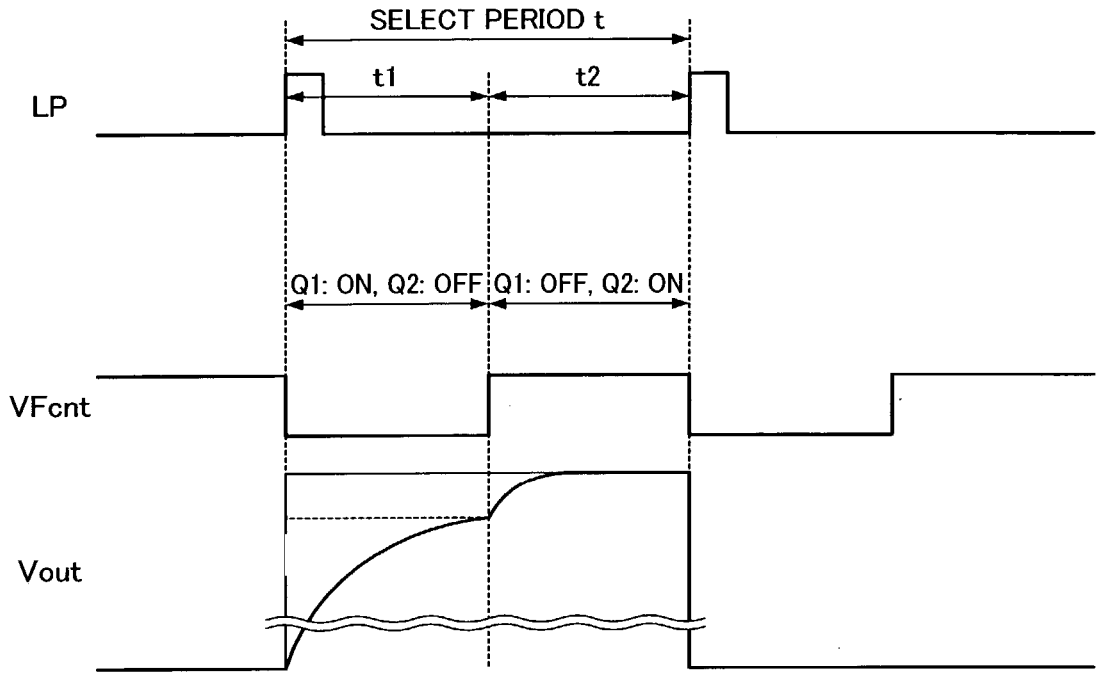
FIG. 5 is a timing chart showing an example of the operation timing of the voltage follower circuit.

FIG. 5 shows an example of the operation timing of the voltage follower circuit 52.

The logic level of the control signal VFcnt generated by the control signal generation circuit 62 is changed between a former period (a given first period of a drive period) t1 and a latter period t2 of a select period (or a drive period) t specified by the latch pulse signal LP. Specifically, when the logic level of the control signal VFcnt becomes "L" in the former period t1, the first switch element Q1 is turned ON and the second switch element Q2 is turned OFF. When the logic level of the control signal VFcnt becomes "H" in the latter period t2, the first switch element Q1 is turned OFF and the second switch element Q2 is turned ON. Therefore, in the former period t1 of the select period t, the signal electrode is driven after impedance transformation by the voltage follower connected operational amplifier 60. In the latter period t2, the signal electrode is driven by using the reference voltage output from the DAC 50.

This enables the drive voltage Vout to be raised at high speed by the voltage follower connected operational amplifier 60 having high drive capability in the former period t1 necessary for charging the liquid crystal capacitance, interconnect capacitance, and the like, and the drive voltage to be output by the DAC 50 in the latter period t2 in which high drive capability is unnecessary. Therefore, the operation period of the operational amplifier 60 which consumes a large amount of current can be minimized, whereby power consumption can be decreased. Moreover, occurrence of a problem in which the charge period becomes insufficient due to a decrease in the select period t accompanied by an increase in the number of lines can be prevented.

The reference voltage generation circuit 48 shown in FIG. 2 is formed so that only some of the resistance circuits can be variably controlled without making all the resistance circuits of the resistance ladder variable, taking grayscale characteristics of a display panel to be driven into consideration. This enables the circuit scale of the resistance ladder, interconnection of control lines, and the control of the resistance ladder to be simplified. In particular, since an increase in the number of grayscale levels involves expectation of an increase in the number of reference voltages to be generated, it is preferable that the reference voltage generation circuit can be multi-purposely used without increasing the circuit size of the resistance ladder circuit as much as possible and irrespective of the type of display panel.

The reference voltage generation circuit 48 variably controls the resistance ladder based on a given command from the user or a variable control signal input through an external input terminal instead of switching interconnects by changing a mask pattern or the like. This enables the signal driver IC 30 to be widely used irrespective of the type of display panel.

The reference voltage generation circuit 48 is described below in detail.

3. Reference Voltage Generation Circuit

Figure 6:
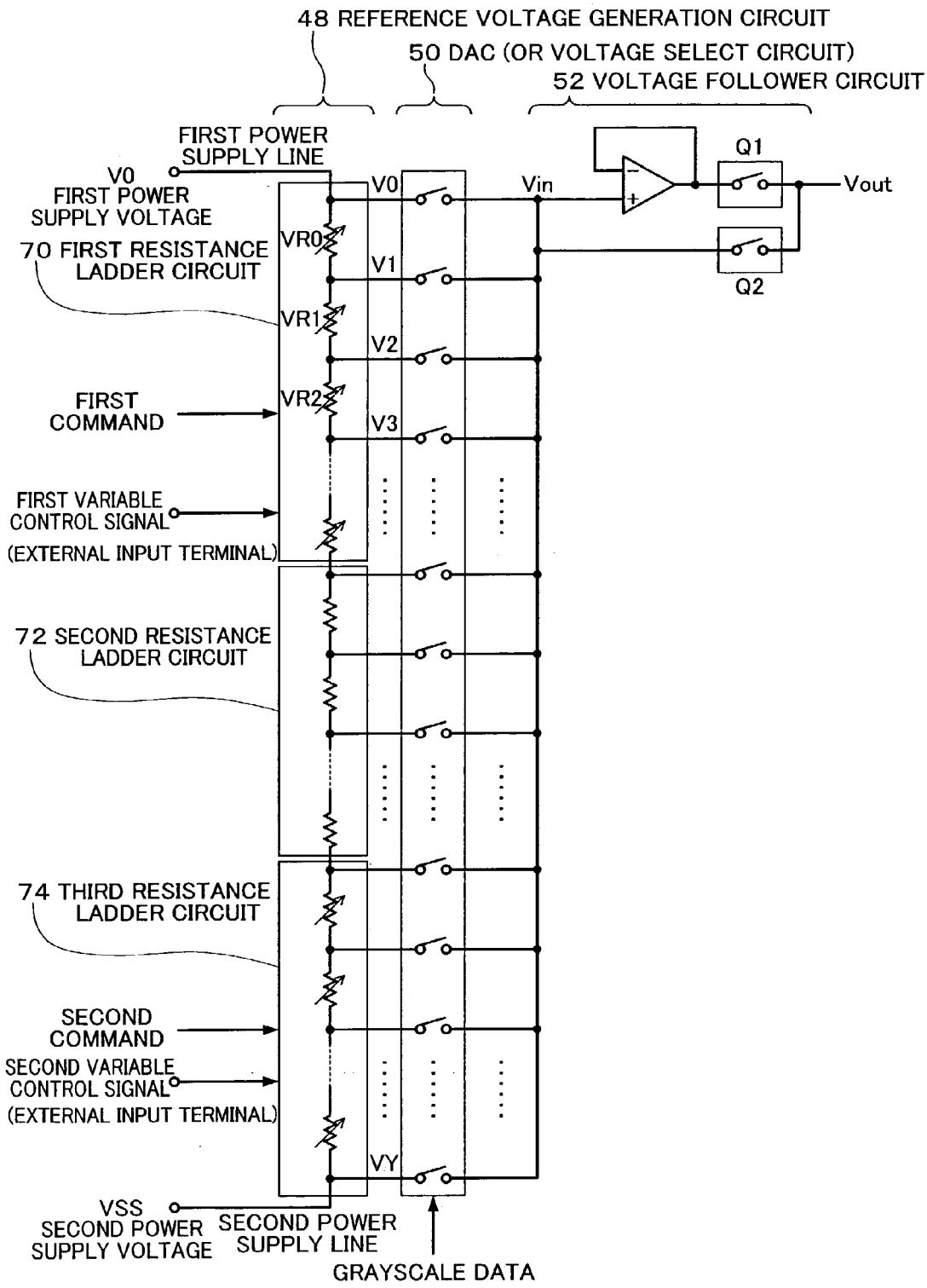
FIG. 6 is a circuit diagram schematically showing the reference voltage generation circuit according to one embodiment of the present invention.

FIG. 6 schematically shows the reference voltage generation circuit 48 according to one embodiment of the present invention.

In addition to the reference voltage generation circuit 48, the DAC 50 and the voltage follower circuit 52 are also illustrated in this figure.

The reference voltage generation circuit 48 outputs the multi-valued reference voltages V0 to VY by the resistance ladder connected between the first power supply line to which the power supply voltage (first power supply voltage) V0 on the high potential side is supplied and the second power supply line to which the power supply voltage (second power supply voltage) VSS on the low potential side is supplied. In more detail, the reference voltage generation circuit 48 includes first to third resistance ladder circuits 70, 72, and 74. The first resistance ladder circuit 70 includes at least one variable resistance circuit in which the resistance value between both ends is variable, and outputs multi-valued voltages. The second resistance ladder circuit 72 has a plurality of series-connected resistance circuits each having a fixed resistance value, and outputs a plurality of voltages. The third resistance ladder circuit 74 includes at least one variable resistance circuit in which the resistance value between both ends is variable, and outputs multi-valued voltages.

The first to third resistance ladder circuits 70, 72, and 74 are connected in series between the first and second power supply lines. In more detail, one end of the first resistance ladder circuit 70 is connected with the first power supply line. The other end of the first resistance ladder circuit 70 is connected with one end of the second resistance ladder circuit 72. The other end of the second resistance ladder circuit 72 is connected with one end of the third resistance ladder circuit 74. The other end of the third resistance ladder circuit 74 is connected with the second power supply line. The first resistance ladder circuit 70 outputs voltages generated between both ends of each resistance circuit in the resistance ladder as the multi-valued reference voltages. The second resistance ladder circuit 72 outputs voltages across the resistance circuits of the resistance ladder as the multi-valued reference voltages. The third resistance ladder circuit 74 outputs voltages across the resistance circuits of the resistance ladder as the multi-valued reference voltages.

The resistance value of the variable resistance circuit of the first resistance ladder circuit 70 is variably controlled based on a first command specified by the user or a first variable control signal input through a given external input terminal, for example. The resistance value of the variable resistance circuit of the third resistance ladder circuit 74 is variably controlled based on a second command specified by the user or a second variable control signal input through a given external input terminal, for example. The first and third resistance ladder circuits 70 and 74 may include a resistance circuit having a fixed resistance value, or may be formed only of the variable resistance circuits. The first and third resistance ladder circuits 70 and 74 include at least one variable resistance circuit. The variable resistance circuit may be realized by a resistance element or a resistance element and a switch element, for example.

The first and second commands may be the same command or separately specified. The first and second variable control signals may be the same signal or separately input.

As described above, the reference voltage generation circuit 48 has a configuration in which only the resistance circuits for generating the reference voltages close to the first and the second power supply voltages are variably controlled in the resistance ladder connected between the first and second power supply lines. This eliminates the need to variably control all the resistance circuits of the resistance ladder, whereby the control is facilitated and an increase in circuit scale can be prevented.

The multi-valued reference voltages V0 to VY generated by the reference voltage generation circuit 48 are supplied to the DAC 50. The DAC 50 includes switch circuits provided for each reference voltage output node. Each switch circuit is alternatively turned ON based on the grayscale data supplied from the latch circuit 46 shown in FIG. 2. The DAC 50 outputs the select voltage to the voltage follower circuit 52 as the output voltage Vin.

3.1 Grayscale Characteristics

Figure 7:
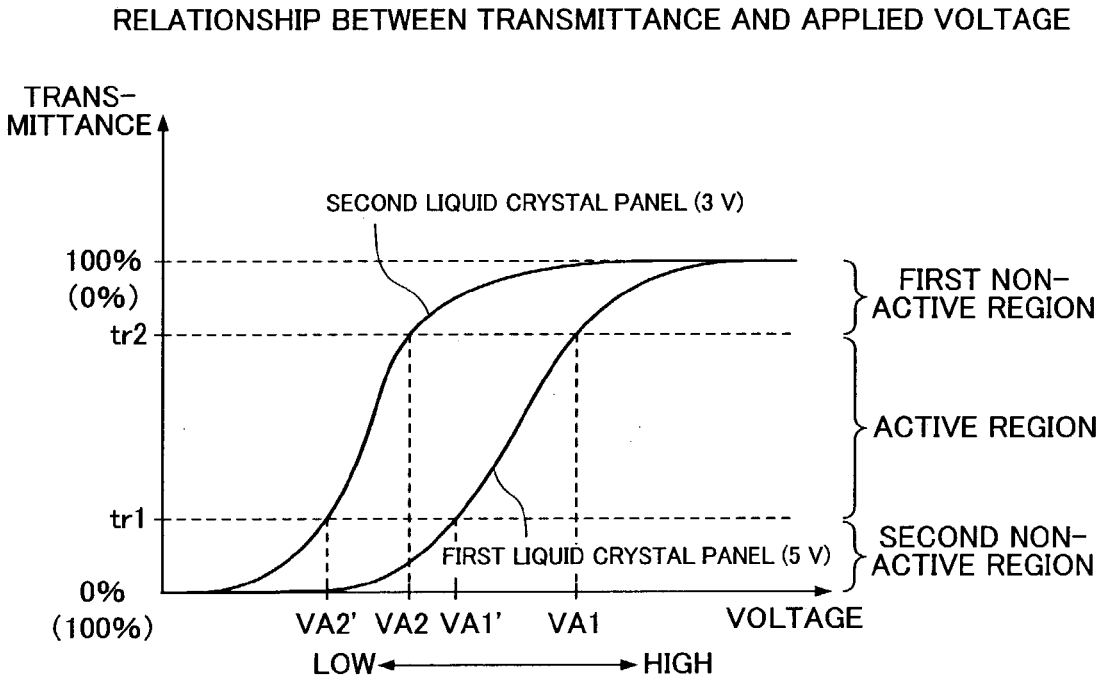
FIG. 7 is a graph illustrating grayscale characteristics.

FIG. 7 is a graph illustrating grayscale characteristics.

Generally, grayscale characteristics of a display panel, in particular a liquid crystal panel, differ depending on the structure of the display panel or a liquid crystal material used therefor. Therefore, it is known that the relationship between the voltage which should be applied to the liquid crystal and the transmittance of the pixel does not become constant. Taking a first liquid crystal panel designed for a power supply voltage of 5 V and a second liquid crystal panel designed for a power supply voltage of 3 V as examples, the range of the applied voltage at which the liquid crystal panel is operated in an active region in which the change in transmittance of the pixel is large differs between the first and second liquid crystal panels, as shown in FIG. 7. Therefore, it is necessary to determine the resistance ratio of the resistance ladder separately for the first and second liquid crystal panels in order to correct the voltage so that optimum grayscale display is realized. The resistance ratio of the resistance ladder used herein refers to a ratio of the resistance value of each resistance circuit of the resistance ladder to the total resistance value of the resistance ladder connected in series between the first and second power supply lines.

Figure 8:
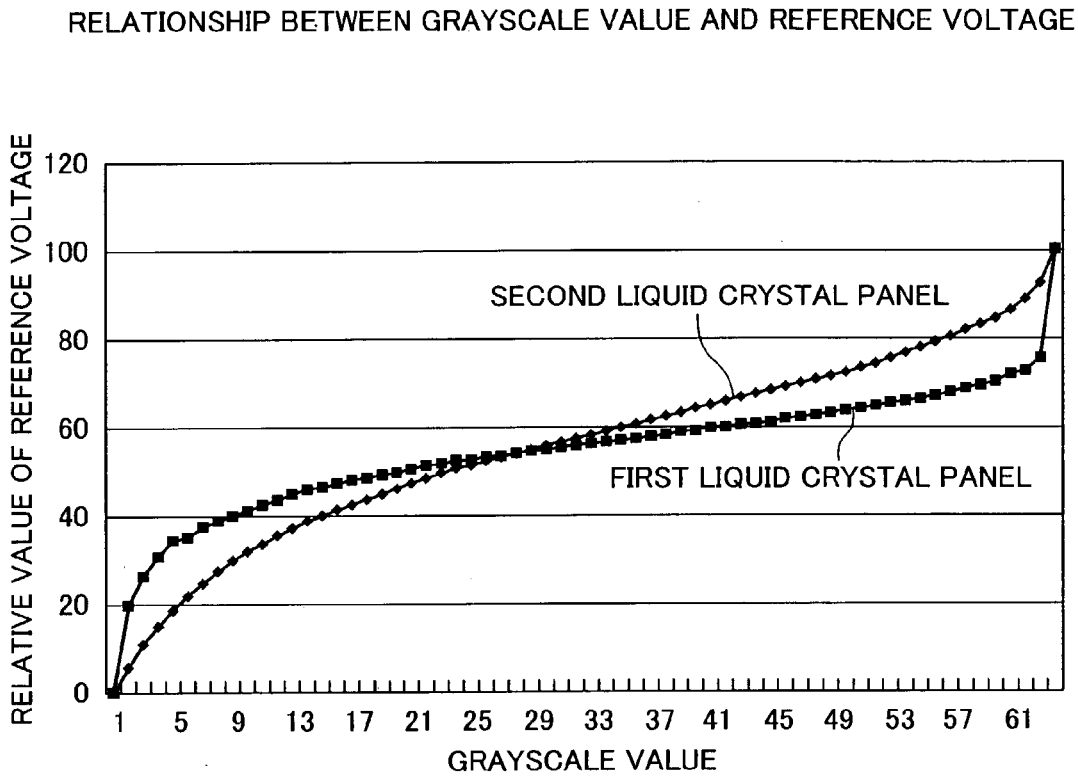
FIG. 8 is a graph illustrating reference voltages optimized for grayscale values in the first and second liquid crystal panels.

FIG. 8 shows reference voltages optimized for grayscale values in the first and second liquid crystal panels.

Reference voltages optimized for 64 grayscale values are indicated by relative value ratios based on the power supply voltage. The relative value of the reference voltage is "100" when the grayscale value is maximum. As shown in FIG. 8, the corrected reference voltages differs depending on the type of liquid crystal panel.

The inventor of the present invention has analyzed the resistance value ratio and obtained the following results. The meaning of the resistance value ratio is as follows. In the case where the resistance ladder is formed by first to P-th (P is a positive integer) resistance circuits connected in series, provided that the resistance value of the L-th ($1 \leqq L \leqq P$, L is a positive integer) resistance circuit which generates the reference voltage optimized for the first liquid crystal panel is a first resistance value, and the resistance value of the L-th resistance circuit which generates the reference voltage optimized for the second liquid crystal panel is a second resistance value, the resistance value ratio refers to the ratio of the first resistance value to the second resistance value.

Figure 9:
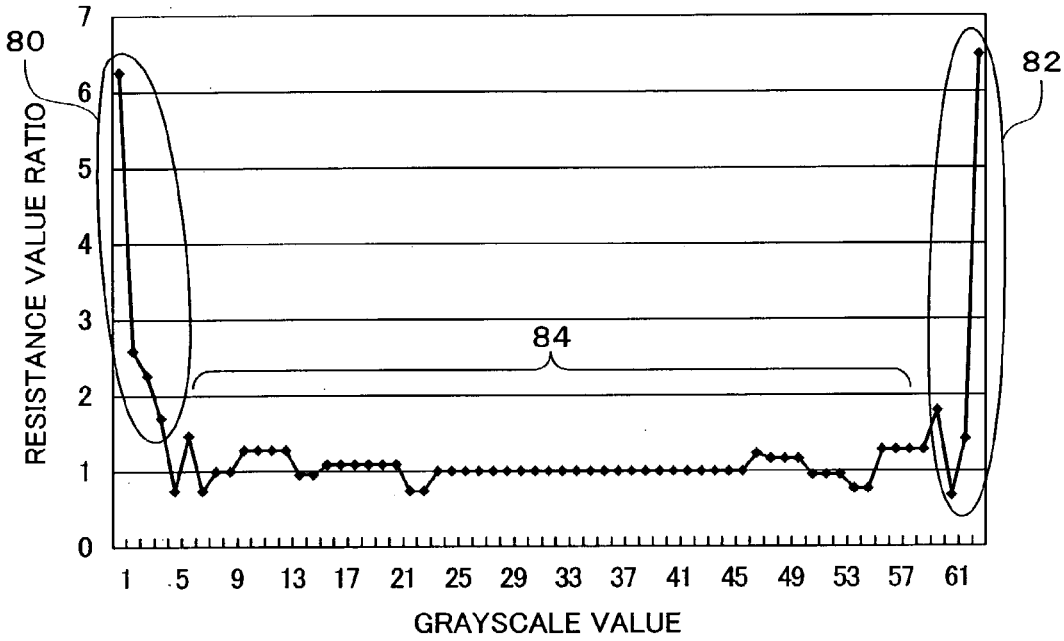
FIG. 9 is a graph showing the relationship between a grayscale value and a resistance value ratio of the first and second liquid crystal panels.

FIG. 9 shows the relationship between a grayscale value and a resistance value ratio of the first and second liquid crystal panels.

63 resistance value ratios necessary for generating the reference voltages for 64 grayscale levels are shown in this graph. The resistance value ratios are increased in sections 80 and 82 in which the reference voltages close to the power supply voltage on the high potential side and the power supply voltage on the low potential side are generated. However, the resistance value ratios in a half tone section 84 are approximately "1". In the case where the resistance value ratio is approximately "1", the resistance values for generating the reference voltages corresponding to the grayscale value are equal.

Figure 10:
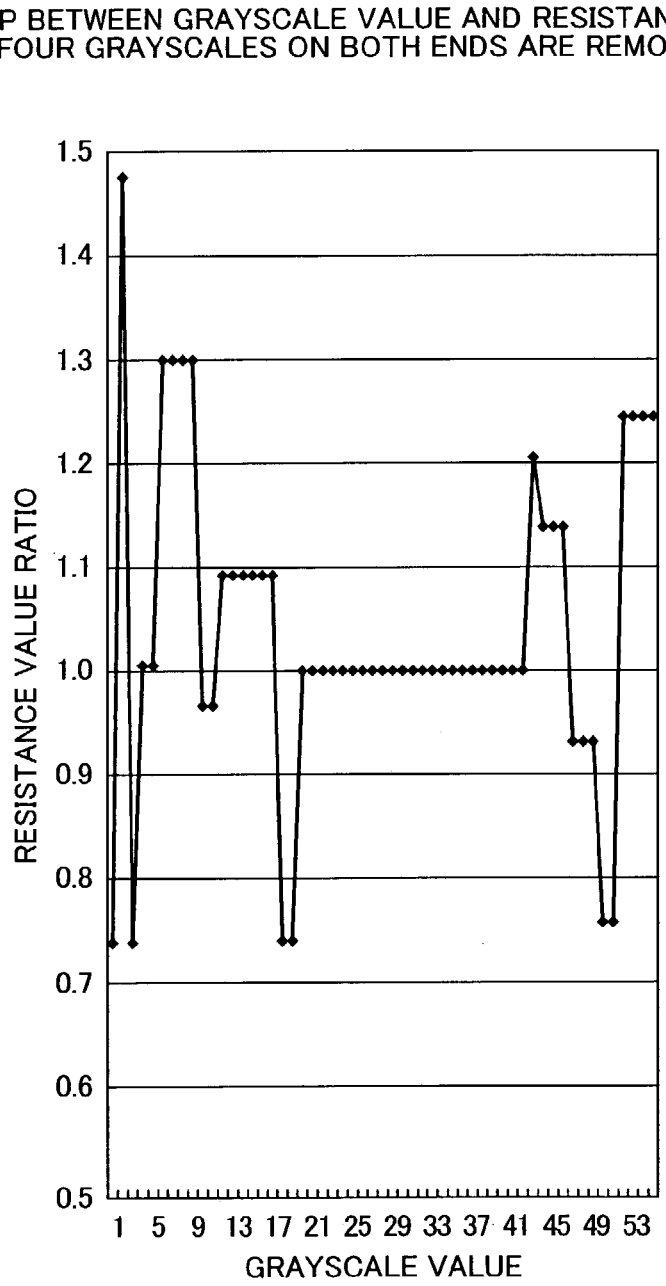
FIG. 10 is a graph showing the relationship between a grayscale value and a resistance value ratio of the first and second liquid crystal panels when four grayscales on each end are removed.

In the case of removing each four grayscales in the sections 80 and 82 in which the reference voltages close to the power supply voltage on the high potential side and the power supply voltage on the low potential side are generated, the resistance values for generating the reference voltages in the half tone become substantially "1", as shown in FIG. 10. Therefore, the resistance circuits for generating the reference voltages in the half tone can be shared.

Figure 11:
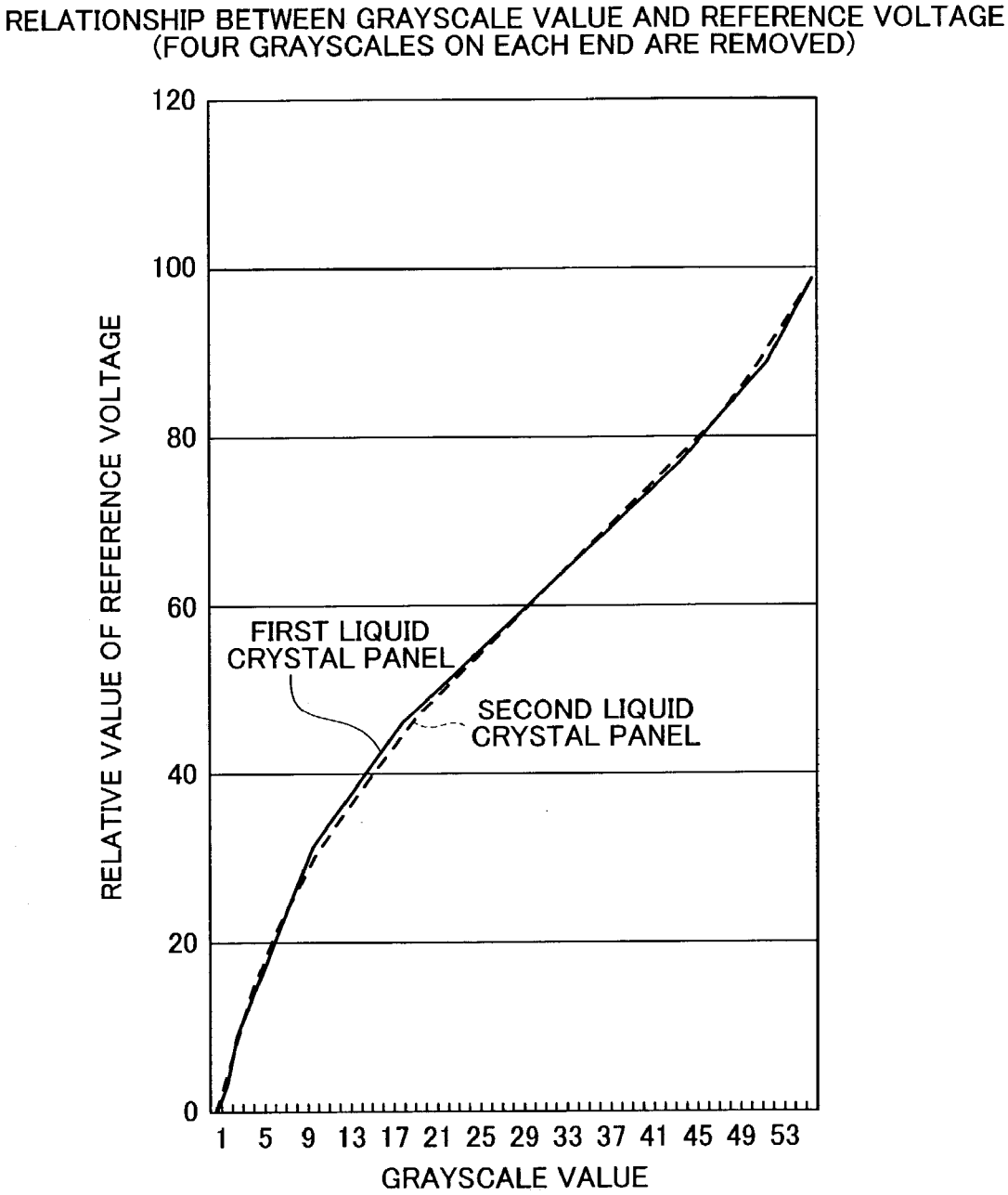
FIG. 11 is a graph showing a reference voltage optimized for grayscale values when four grayscales on each end are removed.

In the case of removing each four grayscales in the sections 80 and 82 in which the reference voltages close to the power supply voltage on the high potential side and the power supply voltage on the low potential side are generated, the grayscale characteristics of the first and second liquid crystal panels shown in FIG. 8 are almost the same in the half tone, as shown in FIG. 11.

Therefore, a reference voltage generation circuit capable of performing gamma correction optimum for different types of liquid crystal panels can be provided by adjusting only the resistance values of several (four, for example) resistance circuits disposed close to the power supply voltages on the high and low potential sides of the resistance ladder. Specifically, it is unnecessary to variably control all the resistance circuits of the resistance ladder.

As shown in FIG. 6, in the reference voltage generation circuit 48, only the first and third resistance ladder circuits 70 and 74 are variably controlled, and the second resistance ladder circuit 72 for generating the reference voltages in the half tone is formed only of the resistance circuits having a fixed resistance value.

If the resistance value ratio of each resistance circuit of the second resistance ladder circuit 72 is two or less, a general-purpose reference voltage generation circuit can be provided without impairing the grayscale characteristics.

Figure 12:
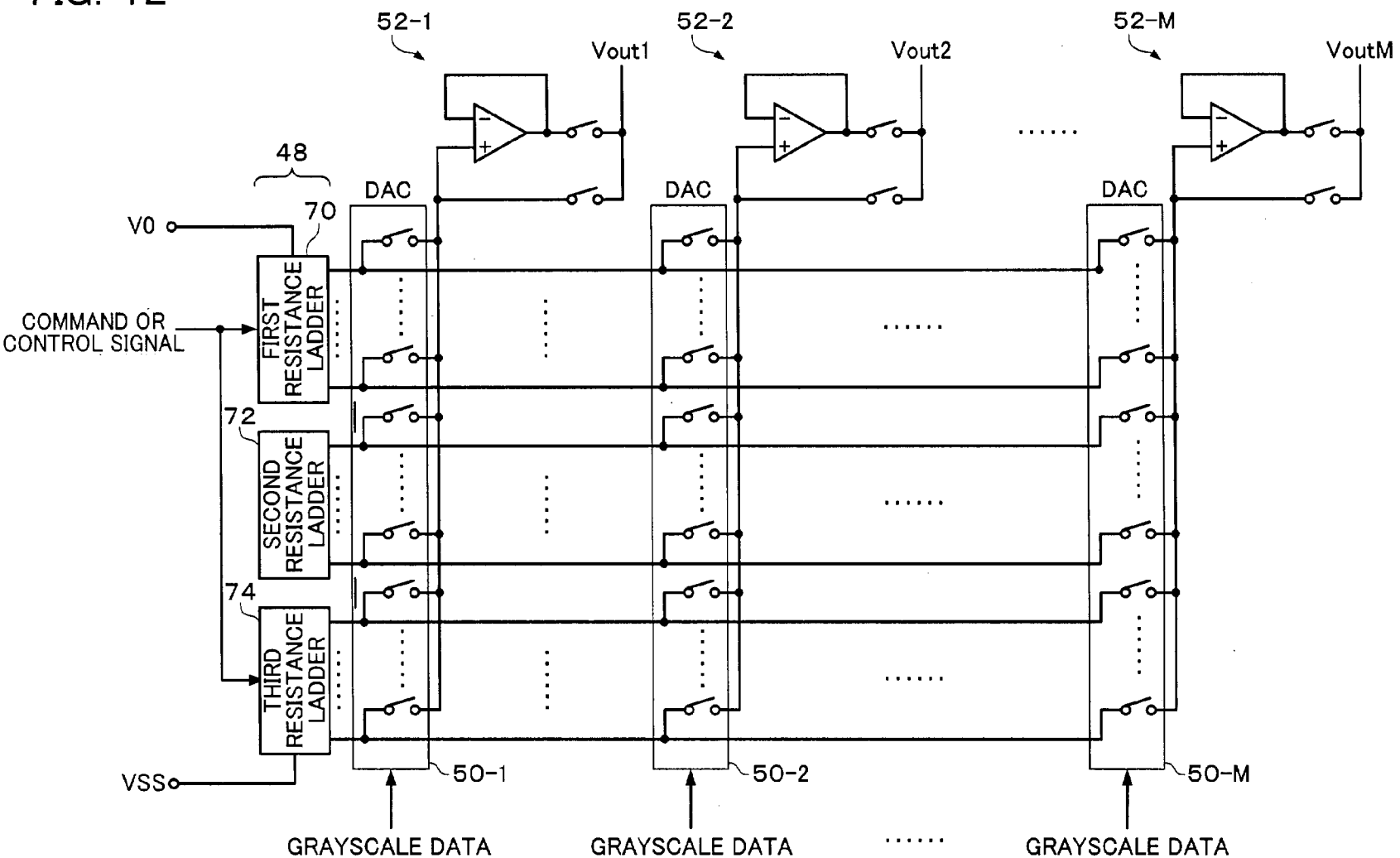
FIG. 12 is a circuit diagram showing an example of the reference voltage generation circuit according to one embodiment of the present invention.

FIG. 12 shows an example of the signal driver IC 30 to which the reference voltage generation circuit 48 is applied.

The reference voltage generation circuit 48 is shared to drive M signal electrodes in this figure. Specifically, the DACs 50-1 to 50-M and the voltage follower circuits 52-1 to 52-M are respectively provided for the M signal electrodes $S_1$ to $S_M$.

The DACs 50-1 to 50-M select one of the multi-valued reference voltages based on the grayscale data corresponding to each signal electrode. The multi-valued reference voltages supplied to the DACs 50-1 to 50-M are generated by the reference voltage generation circuit 48. The reference voltage generation circuit 48 includes the first to third resistance ladder circuits 70, 72, and 74. In the first and third resistance ladder circuits 70 and 74, the resistance values of the resistance circuits of the resistance ladder are variably controlled by the command from the user or the variable control signal input through the external input terminal. This configuration makes the effect of preventing an increase in circuit scale by the reference voltage generation circuit 48 significant, even if the number of signal electrodes is increased.

3.2 Variable Control of Resistance Ladder

In the grayscale characteristics shown in FIG. 7, a region between given transmittances tr1 and tr2 in which the change in transmittance is large is referred to as an active region, and regions other than the active region are referred to as first and second non-active regions. The active region is a region in which the voltage corresponding to the grayscale value in the half tone is applied. The first non-active region is a region in which the transmittance is changed when a higher voltage is applied to the liquid crystal, and the second non-active region is a region in which the transmittance is changed when a lower voltage is applied to the liquid crystal.

Assuming that an applied voltage for obtaining the transmittance tr2 is VA, an applied voltage for obtaining the transmittance tr1 is VA' in a given liquid crystal panel (VA=VA1, and VA'=VA1' in the first liquid crystal panel, VA=VA2, and VA'=VA2' in the second liquid crystal panel), and the difference in voltage between the first and the second power supply voltages is VDIF, the resistance values of the variable resistance circuits which are variably controlled in the first and third resistance ladder circuits 70 and 74 are increased as (VDIF−VA)/VDIF becomes larger, and the resistance values of the variable resistance circuits which are variably controlled in the first and third resistance ladder circuits 70 and 74 are decreased as (VDIF−VA)/VDIF becomes smaller.

For example, the resistance values of the variable resistance circuits which are variably controlled in the first and third resistance ladder circuits 70 and 74 in the first liquid crystal panel shown in FIG. 8 are set larger than the resistance values of the variable resistance circuits which are variably controlled in the first and third resistance ladder circuits 70 and 74 in the second liquid crystal panel.

It is preferable that the resistance value ratio shown in FIG. 9 be two or less in the active region. Specifically, it is preferable that the second resistance ladder circuit 72 be formed so that the resistance circuits having a resistance value ratio of two or less are connected in series. The variable resistance circuits of the first and third resistance ladder circuits 70 and 74 which generate the reference voltages corresponding to grayscale values on both ends are variably controlled as described above.

For example, the signal driver IC 30 including the reference voltage generation circuit 48 shown in FIG. 6 can be widely used irrespective of the display panel to be driven by variably controlling the variable resistance circuits as described above.

3.3 Configuration of Resistance Ladder

The first and third resistance ladder circuits 70 and 74 which are variably controlled in the reference voltage generation circuit 48 as described above may have the following configuration. The following description illustrates the first resistance ladder circuit 70, but the third resistance ladder circuit 74 may have the same configuration as the first resistance ladder circuit 70.

3.3.1 First Example

Figure 13A:
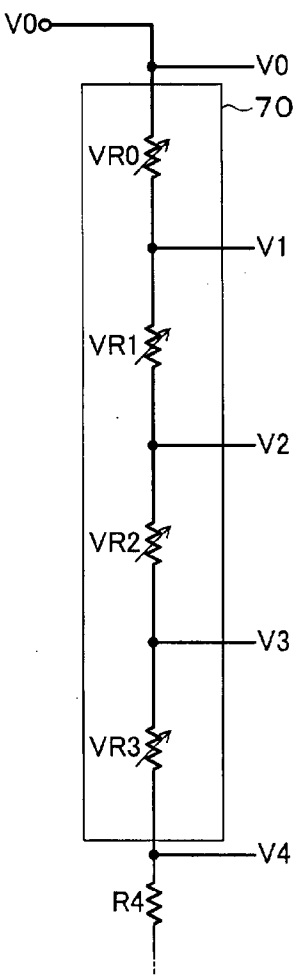
FIGS. 13A to 13C are circuit diagrams showing a first resistance ladder circuit in the first example.
Figure 13B:
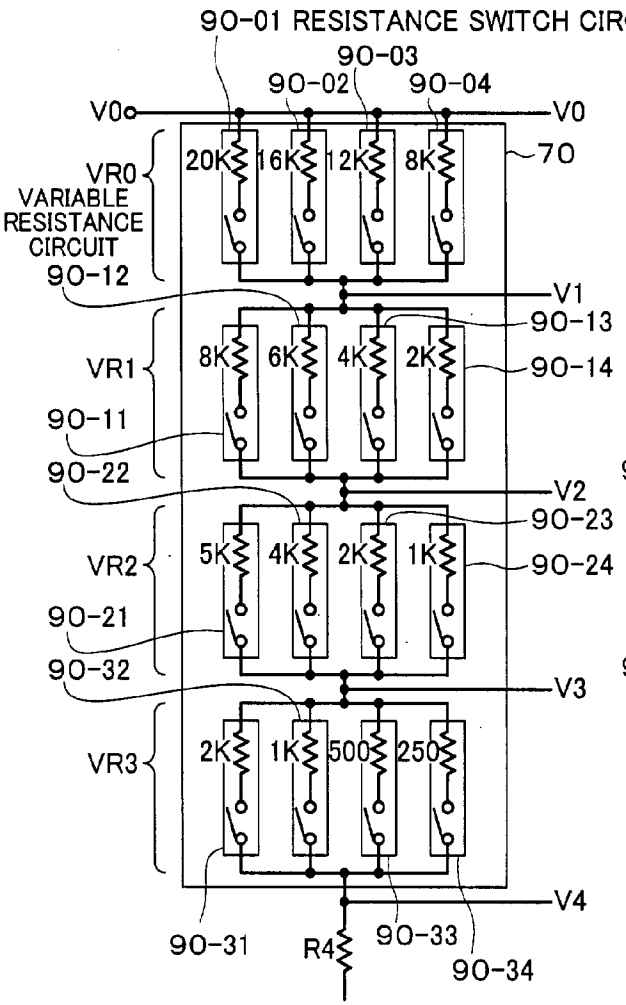
Figure 13C:
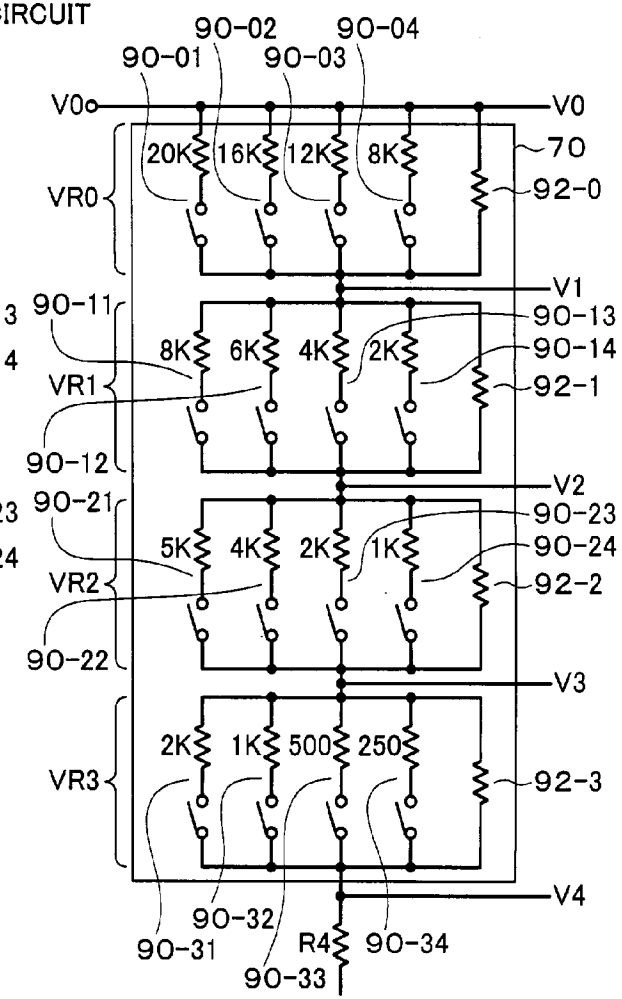

A first example of the first resistance ladder circuit 70 is shown in FIGS. 13A to 13C.

In this example, the first resistance ladder circuit 70 includes variable resistance circuits VR0 to VR3 connected in series, as shown in FIG. 13A.

As shown in FIG. 13B, the variable resistance circuit may be formed by parallelly connecting resistance switch circuits in which a switch circuit (switch element) and a resistance circuit (resistance element) are connected in series. In this case, the resistance switch circuits connected in parallel are controlled so that at least one of the switch circuits is turned ON based on the command or the variable control signal input through the external input terminal.

For example, the variable resistance circuit VR0 may be formed by connecting resistance switch circuits 90-01 to 90-04 in parallel. The variable resistance circuit VR1 may be formed by connecting resistance switch circuits 90-11 to 90-14 in parallel. The variable resistance circuit VR2 may be formed by connecting resistance switch circuits 90-21 to 90-24 in parallel. The variable resistance circuit VR3 may be formed by connecting resistance switch circuits 90-31 to 90-34 in parallel.

As shown in FIG. 13C, a resistance circuit may be further connected in parallel with the resistance switch circuits which are connected in parallel in the variable resistance circuit.

For example, the variable resistance circuit VR0 may be formed by connecting a resistance circuit 92-0 in parallel with the resistance switch circuits 90-01 to 90-04. The variable resistance circuit VR1 may be formed by connecting a resistance circuit 92-1 in parallel with the resistance switch circuits 90-11 to 90-14. The variable resistance circuit VR2 may be formed by connecting a resistance circuit 92-2 in parallel with the resistance switch circuits 90-21 to 90-24. The variable resistance circuit VR3 may be formed by connecting a resistance circuit 92-3 in parallel with the resistance switch circuits 90-31 to 90-34.

In this case, it is unnecessary to control the resistance switch circuits connected in parallel so that at least one of the switch circuits is turned ON. This eliminates the need to avoid a state in which the switch circuits are erroneously set in an open state, or to provide a circuit for avoiding such a state, whereby the configuration or control is simplified.

In this configuration, the switch circuit of each resistance switch circuit is ON-OFF controlled based on the command or the variable control signal input through the external input terminal.

3.3.2 Second Example

Figure 14:
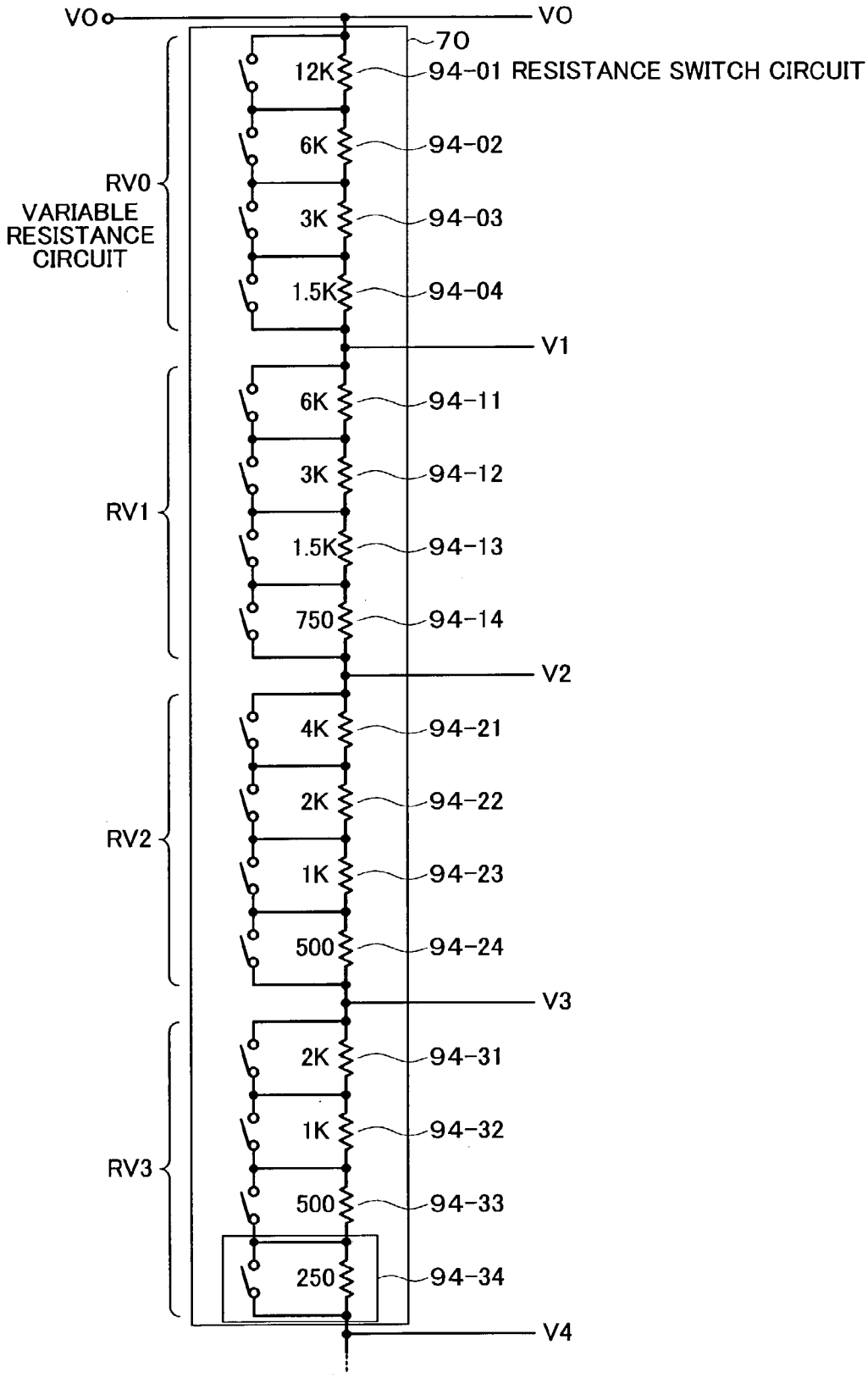
FIG. 14 is a circuit diagram showing the first resistance ladder circuit in the second example.

A second example of the first resistance ladder circuit 70 is shown in FIG. 14.

In this example, the first resistance ladder circuit 70 includes the variable resistance circuits VR0 to VR3 connected in series similarly to FIG. 13A.

The variable resistance circuit may be formed by connecting resistance switch circuits in series in which a resistance circuit and a switch circuit are connected in parallel, as shown in FIG. 14. In this case, the switch element of the resistance switch circuit is ON-OFF controlled based on the command or the variable control signal input through the external input terminal.

For example, the variable resistance circuit VR0 may be formed by connecting resistance switch circuits 94-01 to 94-04 in series. The variable resistance circuit VR1 may be formed by connecting resistance switch circuits 94-11 to 94-14 in series. The variable resistance circuit VR2 may be formed by connecting resistance switch circuits 94-21 to 94-24 in series. The variable resistance circuit VR3 may be formed by connecting resistance switch circuits 94-31 to 94-34 in series.

In this configuration, the switch circuit of each resistance switch circuit is ON-OFF controlled based on the command or the variable control signal input through the external input terminal.

3.3.3 Third Example

Figure 15:
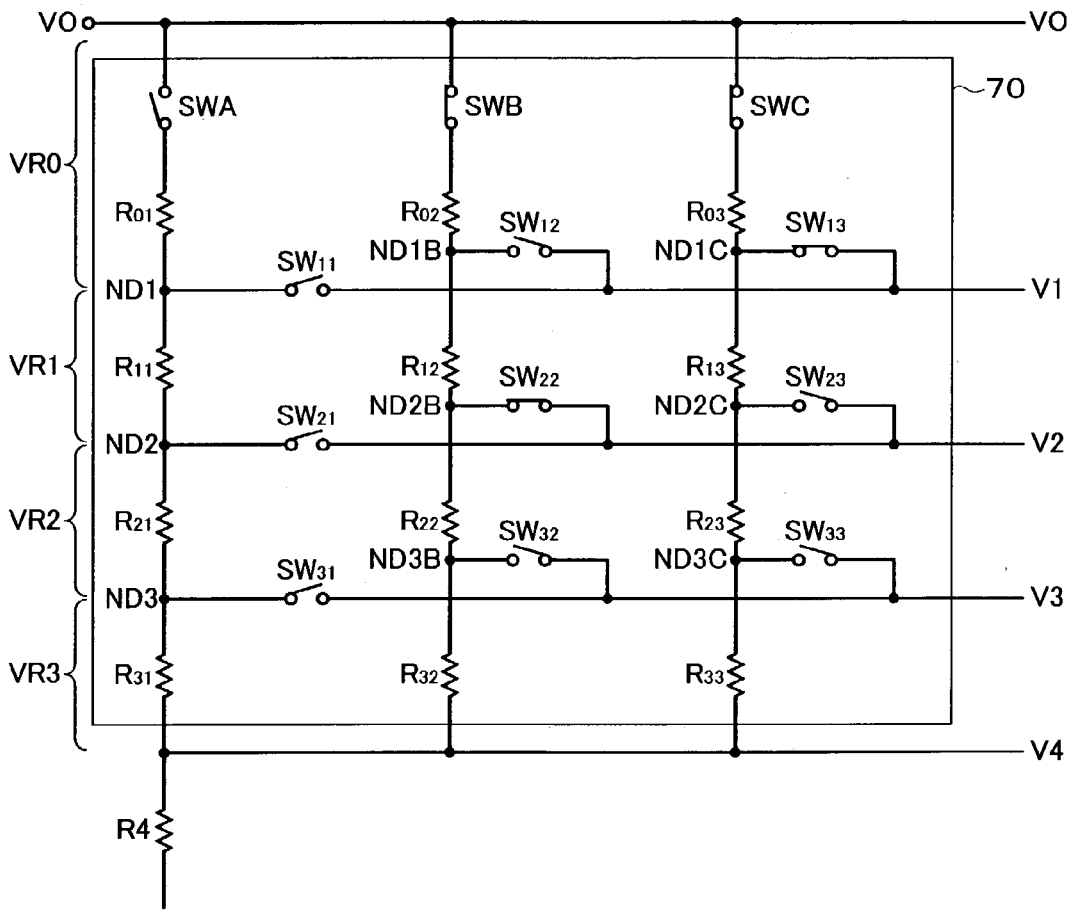
FIG. 15 is a circuit diagram showing the first resistance ladder circuit in the third example.

A third example of the first resistance ladder circuit 70 is shown in FIG. 15.

In this example, the first resistance ladder circuit 70 includes the variable resistance circuits VR0 to VR3 connected in series similarly to FIG. 13A.

In the variable resistance circuit VR0, a switch circuit (switch element) SWA and a resistance circuit $R_{01}$ connected in series are inserted between the first power supply line and the divided node ND1. A switch circuit $SW_{11}$ is inserted between the divided node ND1 and the output node of the reference voltage V1. In the variable resistance circuit VR0, a switch circuit SWB and a resistance circuit $R_{02}$ connected in series are inserted between the first power supply line and a node ND1B. A switch circuit $SW_{12}$ is inserted between the node ND1B and the output node of the reference voltage V1. In the variable resistance circuit VR0, a switch circuit SWC and a resistance circuit $R_{03}$ connected in series are inserted between the first power supply line and a node ND1C. A switch circuit $SW_{13}$ is inserted between the node ND1C and the output node of the reference voltage V1.

In the variable resistance circuit VR1, a resistance circuit $R_{11}$ is inserted between the divided node ND1 and the divided node ND2. A switch circuit $SW_{21}$ is inserted between the divided node ND2 and the output node of the reference voltage V2. In the variable resistance circuit VR1, a resistance circuit $R_{12}$ is inserted between the node ND1B and a node ND2B. A switch circuit $SW_{22}$ is inserted between the node ND2B and the output node of the reference voltage V2. In the variable resistance circuit VR1, a resistance circuit $R_{13}$ is inserted between the node ND1C and a node ND2C. A switch circuit $SW_{23}$ is inserted between the node ND2C and the output node of the reference voltage V2.

In the variable resistance circuit VR2, a resistance circuit $R_{21}$ is inserted between the divided node ND2 and the divided node ND3. A switch circuit $SW_{31}$ is inserted between the divided node ND3 and the output node of the reference voltage V3. In the variable resistance circuit VR2, a resistance circuit $R_{22}$ is inserted between the node ND2B and a node ND3B. A switch circuit $SW_{32}$ is inserted between the node ND3B and the output node of the reference voltage V3. In the variable resistance circuit VR2, a resistance circuit $R_{23}$ is inserted between the node ND2C and a node ND3C. A switch circuit $SW_{33}$ is inserted between the node ND3C and the output node of the reference voltage V3.

In the variable resistance circuit VR3, a resistance circuit $R_{31}$ is inserted between the divided node ND3 and the output node of the reference voltage V4. In the variable resistance circuit VR3, a resistance circuit $R_{32}$ is inserted between the node ND3B and the output node of the reference voltage V4. In the variable resistance circuit VR3, a resistance circuit $R_{33}$ is inserted between the node ND3C and the output node of the reference voltage V4.

In this configuration, the switch circuits SWA, SWB, SWC, $SW_{11}$ to $SW_{13}$, $SW_{21}$ to $SW_{23}$, and $SW_{31}$ to $SW_{33}$ are ON-OFF controlled based on the command or the variable control signal input through the external input terminal.

In the case where the switch circuits SWB, SWC, $SW_{13}$, and $SW_{22}$ are turned ON and the switch circuits SWA, $SW_{11}$, $SW_{12}$, $SW_{21}$, and $SW_{23}$ are turned OFF, a voltage obtained by dropping the power supply voltage V0 through the resistance circuit $R_{03}$ is output as the reference voltage V1, and a voltage obtained by dropping the power supply voltage V0 through the resistance circuit $R_{03}$ and the resistance circuit $R_{12}$ is output as the reference voltage V2.

As described above, since the settable resistance value of the variable resistance circuit of the resistance ladder can be further diversified, a signal driver IC including a reference voltage generation circuit which can be optimized for various display panels can be provided.

3.3.4 Fourth Example

Figure 16:
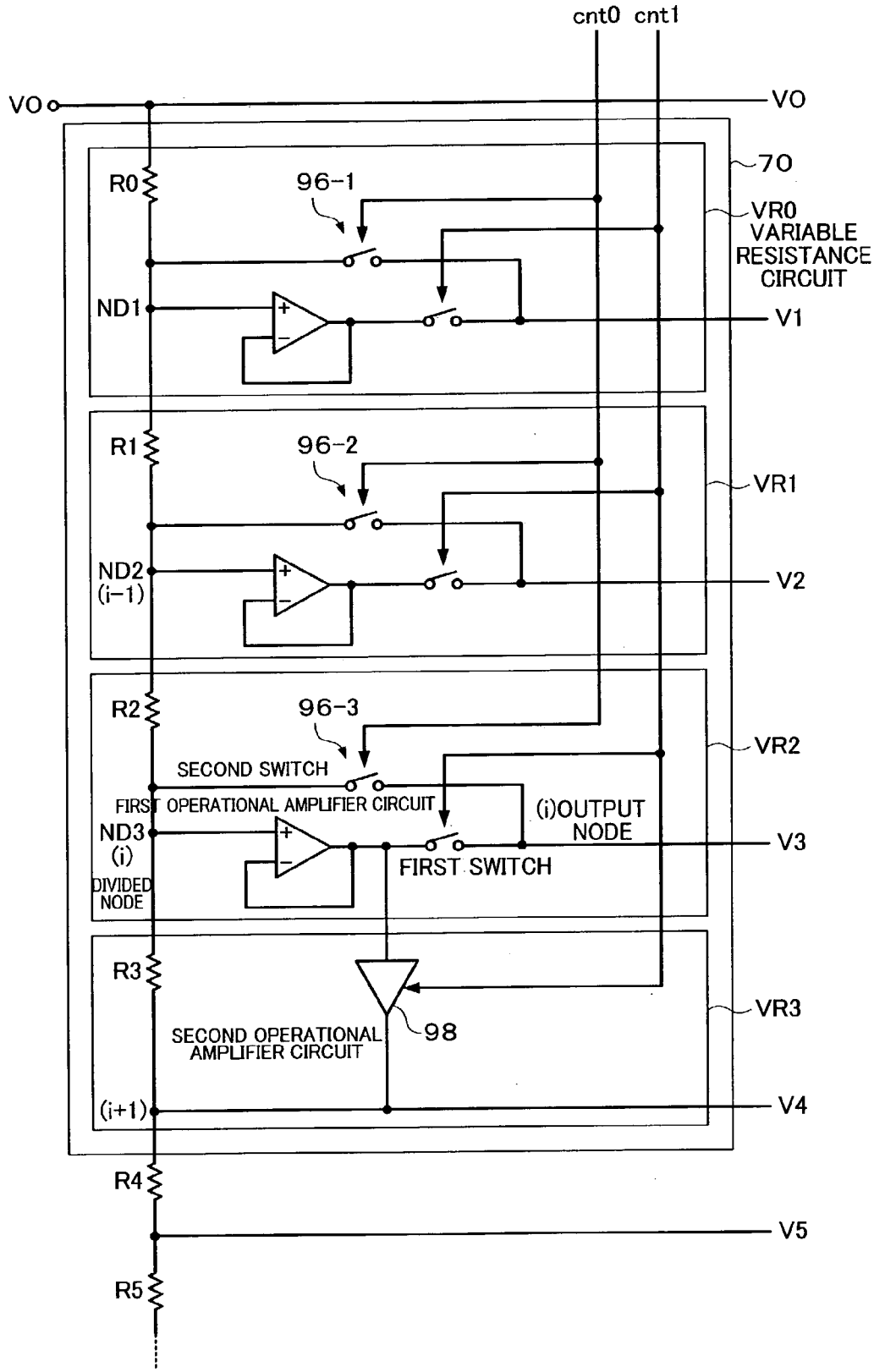
FIG. 16 is a circuit diagram showing the first resistance ladder circuit in the fourth example.

A fourth example of the first resistance ladder circuit 70 is shown in FIG. 16.

In this example, the first resistance ladder circuit 70 includes the variable resistance circuits VR0 to VR3 connected in series similarly to FIG. 13A.

In the variable resistance circuit VR0, a resistance circuit R0 is inserted between the first power supply line and the divided node ND1. In the variable resistance circuit VR0, a voltage follower circuit 96-1 is inserted between the divided node ND1 and the output node of the reference voltage V1. The voltage follower circuit 96-1 has the same configuration as the voltage follower circuit shown in FIG. 4. Each switch circuit of the voltage follower circuit 96-1 is ON-OFF controlled by control signals cnt0 and cnt1.

In the variable resistance circuit VR1, a resistance circuit R1 is inserted between the divided node ND1 and the divided node ND2. In the variable resistance circuit VR1, a voltage follower circuit 96-2 is inserted between the divided node ND2 and the output node of the reference voltage V2. The voltage follower circuit 96-2 has the same configuration as the voltage follower circuit shown in FIG. 4. Each switch circuit of the voltage follower circuit 96-2 is ON-OFF controlled by the control signals cnt0 and cnt1.

In the variable resistance circuit VR2, a resistance circuit R2 is inserted between the divided node ND2 and the divided node ND3. In the variable resistance circuit VR2, a voltage follower circuit 96-3 is inserted between the divided node ND3 and the output node of the reference voltage V3. The voltage follower circuit 96-3 has the same configuration as the voltage follower circuit shown in FIG. 4. Each switch circuit of the voltage follower circuit 96-3 is ON-OFF controlled by the control signals cnt0 and cnt1.

In the variable resistance circuit VR3, a resistance circuit R3 is inserted between the divided node ND3 and the output node of the reference voltage V4. In the variable resistance circuit VR3, an operational amplifier circuit 98 with an offset is inserted between an output terminal of a voltage follower connected operational amplifier of the voltage follower circuit 96-3 and the output node of the reference voltage V4. The operation of the operational amplifier circuit 98 is controlled by the control signal cnt1 (operating current is controlled by the control signal cnt1).

Specifically, a resistance element (resistance circuit R2, for example) is inserted between the i-th ($1 \leqq i \leqq R$, i is an integer) divided node (divided node ND3, for example) for generating the i-th reference voltage (reference voltage V3, for example) and the (i−1)th divided node (divided node ND2, for example) for generating the (i−1)th reference voltage, among the first to R-th reference voltages (R is an integer equal to or larger than 2). The first resistance ladder circuit 70 includes a first voltage follower connected operational amplifier (operational amplifier of the voltage follower circuit 96-3, for example) of which an input terminal is connected with the i-th divided node, a first switch element (first switch element of the voltage follower circuit 96-3, for example) inserted between the output node of the i-th reference voltage and the output of the first operational amplifier circuit, and a second switch element (second switch element of the voltage follower circuit 96-3, for example) inserted between the output node of the i-th reference voltage and the i-th divided node.

In the case where the resistance value of the resistance circuit inserted between the (i+1)th divided node and the (i+2)th divided node is fixed, a second operational amplifier circuit (operational amplifier circuit 98, for example) is inserted between the output of the first operational amplifier (operational amplifier of the voltage follower circuit 96-3, for example) and the output node of the (i+1)th reference voltage.

Figure 17:
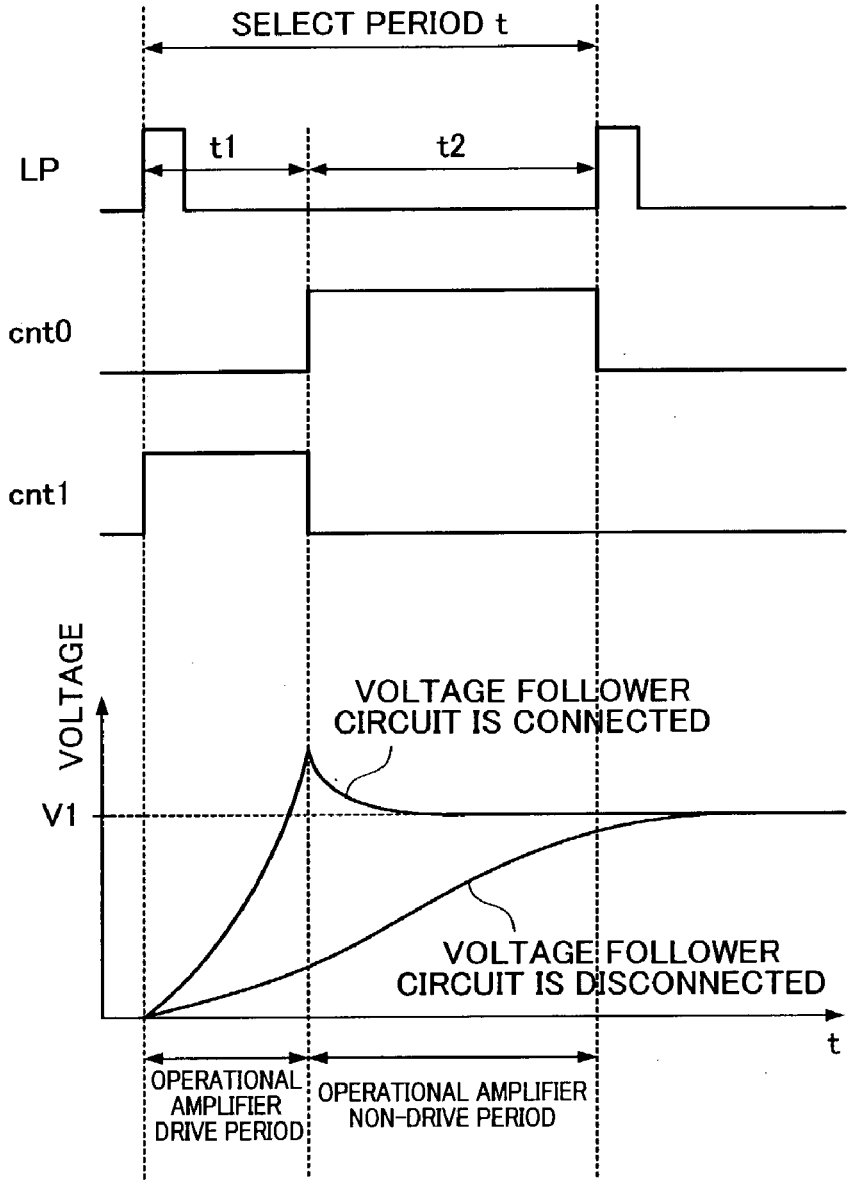
FIG. 17 is a timing chart showing the operation timing of the first resistance ladder circuit in the fourth example.

FIG. 17 shows an example of the control timing of the first resistance ladder circuit 70 shown in FIG. 16.

In the resistance circuit VR0, the logic levels of the control signals cnt0 and cnt1 are changed between the former period (first given period of drive period) t1 and the latter period t2 of the select period (drive period) specified by the latch pulse signal LP, for example. Specifically, when the logic level of the control signal cnt0 becomes "L" and the logic level of the control signal cnt1 becomes "H" in the former period t1, the voltage follower connected operational amplifier drives the output node of the reference voltage V1. When the logic level of the control signal cnt0 becomes "H" and the logic level of the control signal cnt1 becomes "L" in the latter period t2, the divided node ND1 is short-circuited with the output node of the reference voltage V4. Therefore, impedance transformation is performed by the voltage follower connected operational amplifier and the output node of the reference voltage V1 is driven in the former period t1 of the select period t. In the latter period t2, the voltage of the output node of the reference voltage V1 is determined through the resistance circuit R0.

Specifically, the drive voltage Vout can be raised at high speed by the voltage follower connected operational amplifier having high drive capability in the former period t1 necessary for charging the liquid crystal capacitance, interconnect capacitance, and the like, and the drive voltage can be output by the resistance circuit R0 in the latter period t2 in which high drive capability is unnecessary, as shown in FIG. 17. Therefore, since the impedance transformation can be performed by the voltage follower circuit, effects the same as in the first to third examples can be obtained.

Since the operating current steadily flows through the operational amplifiers of the voltage follower circuits 96-1 to 96-3 during operation, it is preferable to limit or terminate the operating current in the latter period t2 of the select period t.

In the variable resistance circuit VR3, the reference voltage V3 to which an offset voltage is added by the operational amplifier circuit 98 is output as the reference voltage V4 in the former period t1 of the select period t.

It is preferable to limit or terminate the operating current of the operational amplifier circuit 98 in the latter period t2 of the select period t.

Figure 18:
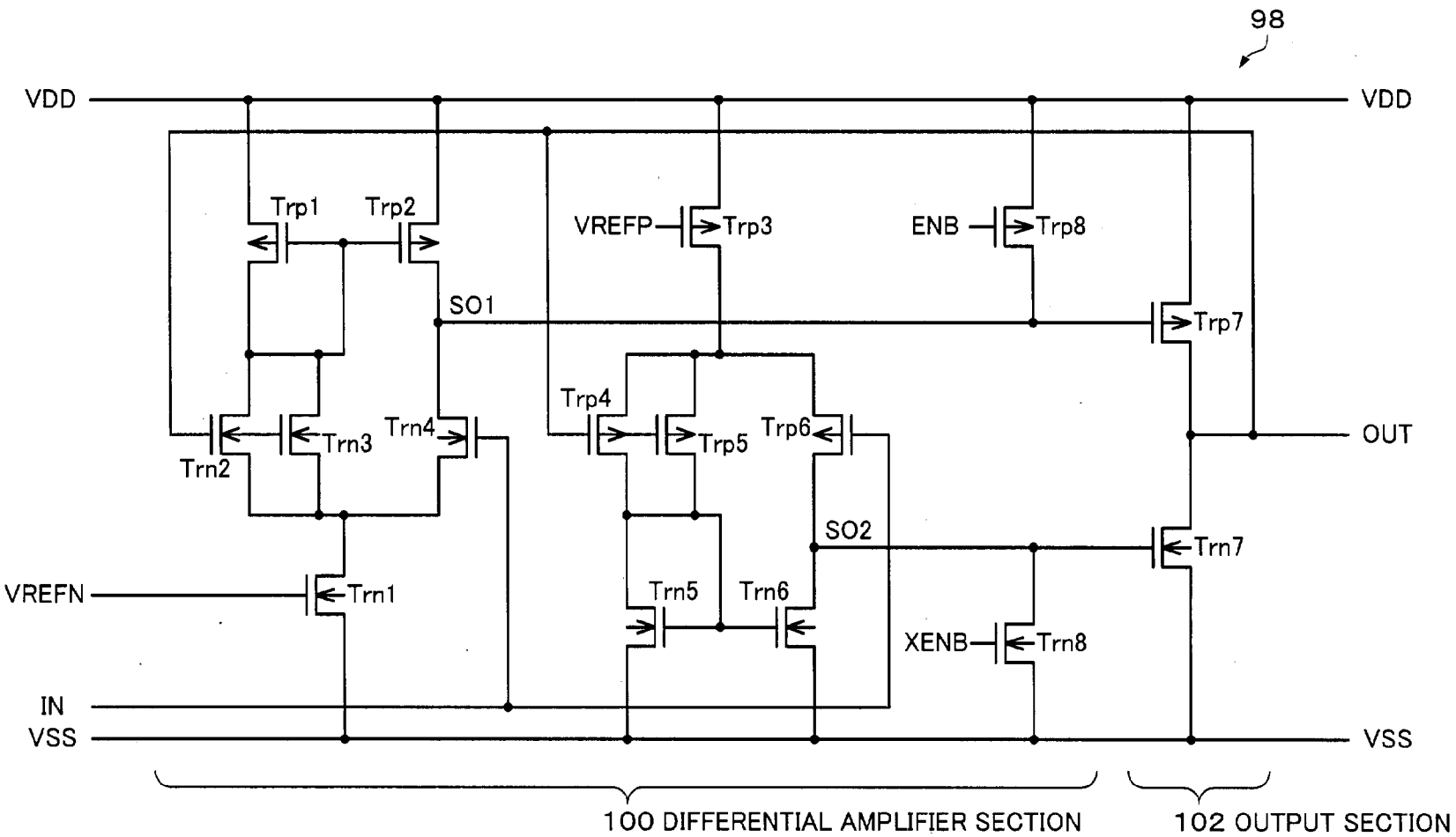
FIG. 18 is a circuit diagram showing an example of the operational amplifier circuit.

FIG. 18 is a detailed circuit diagram showing an example of the operational amplifier circuit 98.

The operational amplifier circuit 98 includes a differential amplifier section 100 and an output section 102.

The differential amplifier section 100 includes first and second differential amplifier sections 104 and 106.

The first differential amplifier section 104 utilizes current flowing between a drain and a source of an n-type MOS transistor Trn1 (n-type MOS transistor Trnx (x is an integer) is hereinafter abbreviated as "transistor Trnx") to which a reference signal VREFN is applied at a gate electrode as a current source. The current source is connected with source terminals of transistors Trn2 to Trn4. An output signal OUT of the operational amplifier circuit 98 is applied to gate electrodes of the transistors Trn2 and Trn3. An input signal IN is applied to a gate electrode of the transistor Trn4.

The drain terminals of the transistors Trn2 to Trn4 are connected with drain terminals of p-type MOS transistors Trp1 (p-type MOS transistor Trpy (y is an integer) is hereinafter abbreviated as "transistor Trpy") and Trp2 having a current mirror structure. Gate electrodes of the transistors Trp1 and Trp2 are connected with drain terminals of the transistors Trn2 and Trn3.

A differential output signal SO1 is output from the drain terminal of the transistor Trp2.

The second differential amplifier section 106 utilizes current flowing between a drain and a source of a transistor Trp3 to which a reference signal VREFP is applied at a gate electrode as a current source. The current source is connected with source terminals of transistors Trp4 to Trp6. The output signal OUT of the operational amplifier circuit 98 is applied to gate electrodes of the transistors Trp4 and Trp5. The input signal IN is applied to a gate electrode of the transistor Trp6.

The drain terminals of the transistors Trp4 to Trp6 are connected with drain terminals of transistors Trn5 and Trn6 having a current mirror structure. Gate electrodes of the transistors Trn5 and Trn6 are connected with the drain terminals of the transistors Trp4 and Trp5.

A differential output signal SO2 is output from the drain terminal of the transistor Trn6.

The output section 102 includes transistors Trp7 and Trn7 connected in series between the power supply voltage VDD and the ground power supply voltage VSS. The differential output signal SO1 is applied to a gate electrode of the transistor Trp7. The differential output signal SO2 is applied to a gate electrode of the transistor Trn7. The output signal OUT is output from drain terminals of the transistors Trp7 and Trn7.

The gate electrode of the transistor Trp7 is connected with a drain terminal of a transistor Trp8. A source terminal of the transistor Trp8 is connected with the power supply voltage VDD. An enable signal ENB is applied to a gate electrode of the transistor Trp8. The gate electrode of the transistor Trn7 is connected with a drain terminal of a transistor Trn8. A source terminal of the transistor Trn8 is connected with the ground power supply voltage VSS. An inverted enable signal XENB is applied to a gate electrode of the transistor Trn8.

Figure 19:
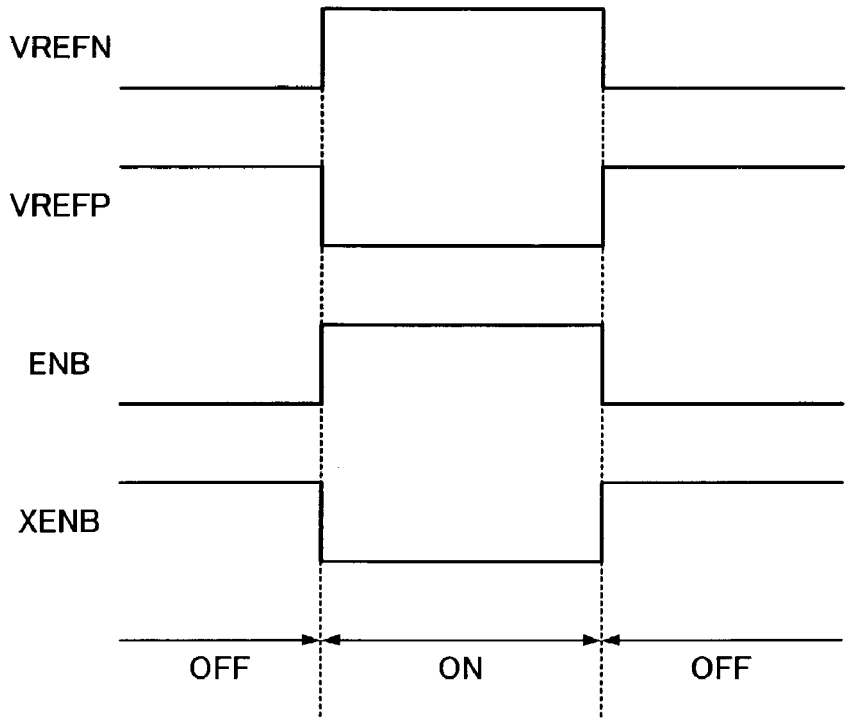
FIG. 19 is a timing chart showing the operation control timing of the operational amplifier circuit.

The operational amplifier circuit 98 having the above-described configuration makes the reference signals VREFN and VREFP, the enable signal ENB, and the inverted enable signal XENB operate, and outputs the output signal OUT which is a voltage obtained by adding an offset voltage to the input signal IN, as shown in FIG. 19. The control signal cnt1 shown in FIGS. 16 and 17 may be used as the reference signal VREFN and the enable signal ENB. A signal obtained by inverting the control signal cnt1 may be used as the reference signal VREFP and the inverted enable signal XENB.

In the first differential amplifier section 104, when the logic level of the reference signal VREFN becomes "H" and the transistor Trn1 starts to be operated as the current source, voltage corresponding to the difference in drive capability between the transistors Trn2 and Trn3 and the transistor Trn4 which make a differential pair is output as the differential output signal SO1 based on the output signal OUT and the input signal IN. At this time, since the transistor Trp8 is turned OFF, the differential output signal SO1 is applied to the gate electrode of the transistor Trp7. In the second differential amplifier section 106, the differential output signal SO2 is applied to the gate electrode of the transistor Trn7. As a result, the output section 102 outputs the output signal OUT which is the input signal IN to which an offset corresponding to the drive capability of the transistors which make up the differential pair is added.

In the first differential amplifier section 104, since the amplification operation cannot be performed when the logic level of the reference signal VREFN becomes "L" and the transistor Trn1 is turned OFF, the power supply voltage VDD is applied to the gate electrode of the transistor Trp7 through the transistor Trp8. In the second differential amplifier section 106, the ground power supply voltage VSS is applied to the gate electrode of the transistor Trn7 through the transistor Trn8. As a result, the output section 102 puts its output in a high impedance state. Since the current flowing through the current source can be limited or terminated by the reference signals VREFN and VREFP, the operating current can be prevented from flowing in a period in which the operation is unnecessary.

This enables the operational amplifier circuit 98 to add an offset with high accuracy. Therefore, in the fourth example, the resistance value of the variable resistance circuit can be variably controlled by using impedance transformation by the voltage follower circuit, whereby a general-purpose reference voltage generation circuit irrespective of the type of display panel can be formed.

In the fourth example, the variable resistance circuits VR0 to VR3 are variably controlled by the control signals cnt0 and cnt1. However, the present invention is not limited thereto. The variable resistance circuits VR0 to VR3 may be variably controlled by different control signals.

4. Others

The above embodiments are described taking the liquid crystal device including a liquid crystal panel using TFTs as an example, but the present invention is not limited thereto. The reference voltage generated by the reference voltage generation circuit 48 may be changed into current by a given current conversion circuit and supplied to a current driven type element. This enables the present invention to be applied to a signal driver IC which drives an organic EL panel including organic EL elements provided corresponding to pixels specified by signal electrodes and scanning electrodes, for example.

Figure 20:
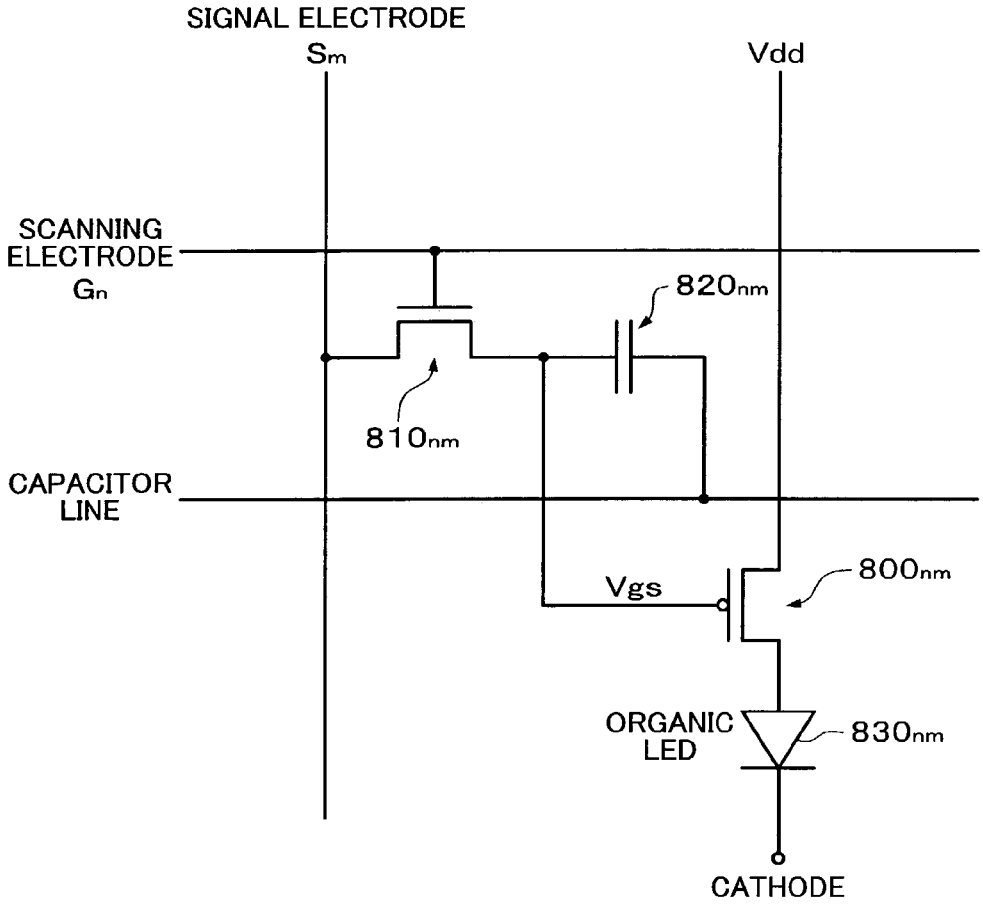
FIG. 20 is a circuit diagram showing an example of a two-transistor pixel circuit in an organic EL panel.

FIG. 20 is a circuit diagram showing an example of a two-transistor pixel circuit in an organic EL panel driven by such a signal driver IC.

The organic EL panel includes a drive TFT $\mathbf{800}_{nm}$, a switch TFT $\mathbf{810}_{nm}$, a storage capacitor $\mathbf{820}_{nm}$, and an organic LED $\mathbf{830}_{nm}$ at an intersection point between a signal electrode $S_m$ and a scanning electrode $G_n$. The drive TFT $\mathbf{800}_{nm}$ is formed by a p-type transistor.

The drive TFT $\mathbf{800}_{nm}$ and the organic LED $\mathbf{830}_{nm}$ are connected in series with a power supply line.

The switch TFT $\mathbf{810}_{nm}$ is inserted between a gate electrode of the drive TFT $\mathbf{800}_{nm}$ and the signal electrode $S_m$. A gate electrode of the switch TFT $\mathbf{810}_{nm}$ is connected with the scanning electrode $G_n$.

The storage capacitor $\mathbf{820}_{nm}$ is inserted between the gate electrode of the drive TFT $\mathbf{800}_{nm}$ and a capacitor line.

In this organic EL element, when the scanning electrode $G_n$ is driven and the switch TFT $\mathbf{810}_{nm}$ is turned ON, voltage of the signal electrode $S_m$ is written into the storage capacitor $\mathbf{820}_{nm}$ and applied to the gate electrode of the drive TFT $\mathbf{800}_{nm}$. A gate voltage Vgs of the drive TFT $\mathbf{800}_{nm}$ is determined depending on the voltage of the signal electrode $S_m$, whereby current flowing through the drive TFT $\mathbf{800}_{nm}$ is determined. Since the drive TFT $\mathbf{800}_{nm}$ and the organic LED $\mathbf{830}_{nm}$ are connected in series, the current flowing through the drive TFT $\mathbf{800}_{nm}$ flows through the organic LED $\mathbf{830}_{nm}$.

Therefore, if the gate voltage Vgs corresponding to the voltage of the signal electrode $S_m$ is held by the storage capacitor $\mathbf{820}_{nm}$, for example, in the case where current corresponding to the gate voltage Vgs is caused to flow through the organic LED $\mathbf{830}_{nm}$ in one frame period, a pixel which continues to shine during the frame can be realized.

Figure 21A:
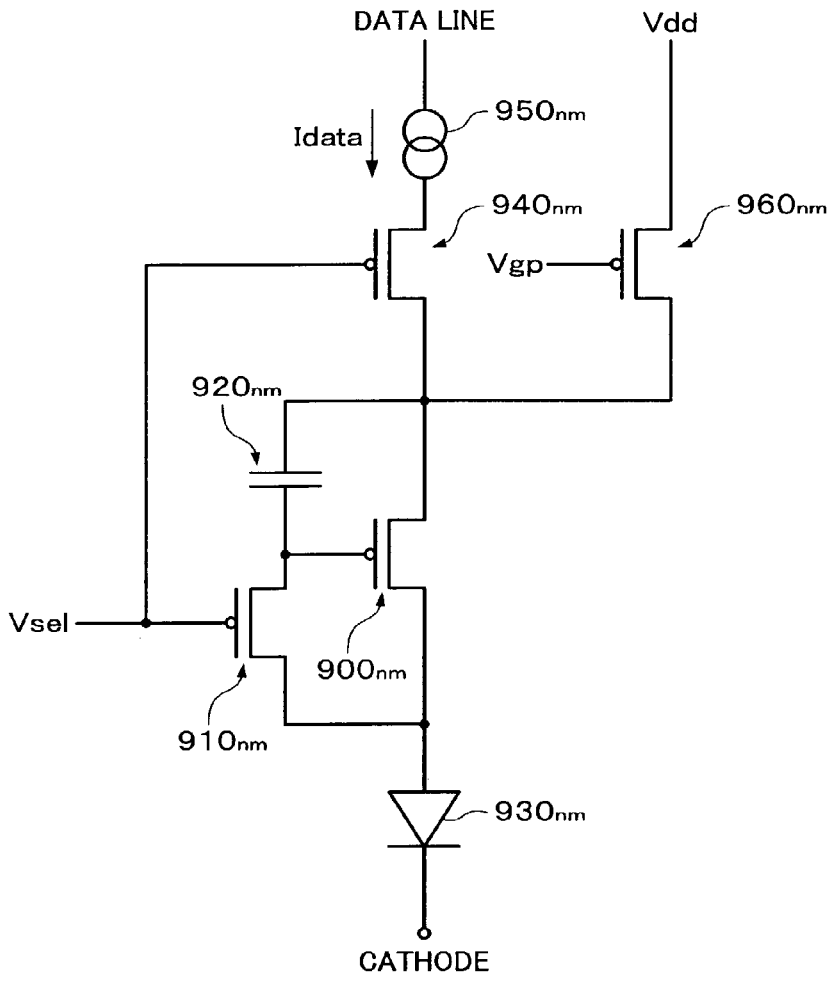
FIG. 21A is a circuit diagram showing an example of a four-transistor pixel circuit in an organic EL panel.
Figure 21B:
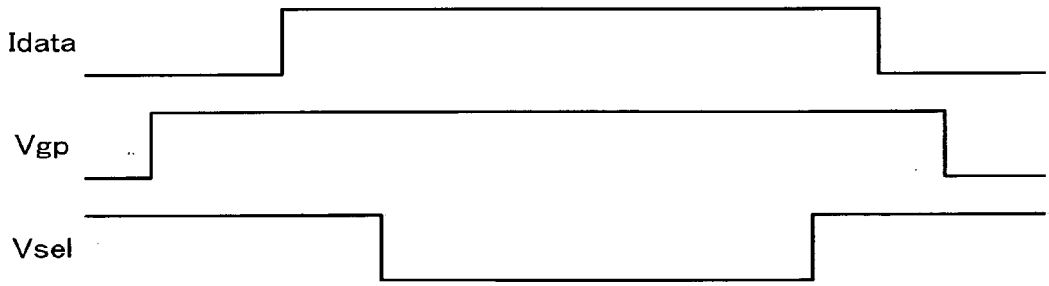
FIG. 21B is a timing chart showing an example of the display control timing of the pixel circuit.

FIG. 21A shows an example of a four-transistor pixel circuit in an organic EL panel driven by the signal driver IC. FIG. 21B shows an example of the display control timing of the pixel circuit.

The organic EL panel includes a drive TFT $\mathbf{900}_{nm}$, a switch TFT $\mathbf{910}_{nm}$, a storage capacitor $\mathbf{920}_{nm}$, and an organic LED $\mathbf{930}_{nm}$.

The features differing from the two-transistor pixel circuit shown in FIG. 20 are that a constant current Idata from a constant current source $\mathbf{950}_{nm}$ is supplied to the pixel through a p-type TFT $\mathbf{940}_{nm}$ as a switch element instead of a constant voltage, and the storage capacitor $\mathbf{920}_{nm}$ and the drive TFT $\mathbf{900}_{nm}$ are connected with the power supply line through a p-type TFT $\mathbf{960}_{nm}$ as a switch element.

In this organic EL element, the power supply line is disconnected by allowing the p-type TFT $960_{nm}$ to be turned OFF by a gate voltage Vgp, and the constant current Idata from the constant current source $950_{nm}$ is caused to flow through the drive TFT $900_{nm}$ by allowing the p-type TFT $940_{nm}$ and the switch TFT $910_{nm}$ to be turned ON by a gate voltage Vsel.

Voltage corresponding to the constant current Idata is held by the storage capacitor $920_{nm}$ until the current flowing through the drive TFT $900_{nm}$ becomes stable.

The p-type TFT $940_{nm}$ and the switch TFT $910_{nm}$ are turned OFF by the gate voltage Vsel and the p-type TFT $960_{nm}$ is turned ON by the gate voltage Vgp, whereby the power supply line is electrically connected with the drive TFT $900_{nm}$ and the organic LED $930_{nm}$. Current almost equal to or in an amount corresponding to the constant current Idata is supplied to the organic LED $930_{nm}$ by the voltage held by the storage capacitor $920_{nm}$.

In this organic EL element, the scanning electrode may be used as an electrode to which the gate voltage Vsel is applied, and the signal electrode may be used as a data line.

The organic LED may have a structure in which a light-emitting layer is provided on a transparent anode (ITO) and a metal cathode is provided on the light-emitting layer, or a structure in which a light-emitting layer, a light-transmitting cathode, and a transparent seal are provided on a metal anode. The element structure of the organic LED is not limited.

A signal driver IC which is widely used for organic EL panels can be provided by forming a signal driver IC which drives an organic EL panel including organic EL elements as described above.

The present invention is not limited to the above-described embodiments. Various modifications can be made within the scope of the invention. For example, the present invention may be applied to plasma display devices.

What is claimed is:

1. A reference voltage generation circuit which generates multi-valued reference voltages for generating a gamma-corrected grayscale value based on grayscale data, the reference voltage generation circuit comprising:

a first resistance ladder circuit having at least one variable resistance circuit in which a resistance value between both ends is variable, and outputting multi-valued voltages;

a second resistance ladder circuit in which a plurality of resistance circuits each having a fixed resistance value are connected in series, outputting a plurality of voltages; and a third resistance ladder circuit having at least one variable resistance circuit in which a resistance value between both ends is variable, and outputting multi-valued voltages, wherein the first to third resistance ladder circuits are connected in series between first and second power supply lines to which first and second power supply voltages are respectively supplied; and wherein the resistance values of the variable resistance circuits in the first and third resistance ladder circuits are variably controlled according to a given command setting or a given variable control signal.

2. The reference voltage generation circuit as defined in claim 1, wherein at least one of the variable resistance circuits of the first and third resistance ladder circuits includes parallel-connected resistance switch circuits, each of the resistance switch circuits having a switch element and a resistance element connected to each other in series.

3. The reference voltage generation circuit as defined in claim 2, wherein the variable resistance circuit further includes a resistance element connected in parallel with at least one of the resistance switch circuits.

4. The reference voltage generation circuit as defined in claim 3, wherein:

each of the first to third resistance ladder circuits is formed of the first to P-th resistance circuits (P is a positive integer); and in the second resistance ladder circuit, a ratio of a first resistance value of the L-th resistance circuit ($1 \leqq L \leqq P$, L is an integer) when driving a first display panel to a second resistance value of the L-th resistance circuit when driving a second display panel is equal to or less than 2.

5. The reference voltage generation circuit as defined in claim 2, wherein at least one of the first and third resistance ladder circuits has at least two of the variable resistance circuits which are connected to each other in series.

6. The reference voltage generation circuit as defined in claim 5, wherein:

each of the first to third resistance ladder circuits is formed of the first to P-th resistance circuits (P is a positive integer); and in the second resistance ladder circuit, a ratio of a first resistance value of the L-th resistance circuit ($1 \leqq L \leqq P$, L is an integer) when driving a first display panel to a second resistance value of the L-th resistance circuit when driving a second display panel is equal to or less than 2.

7. The reference voltage generation circuit as defined in claim 2, wherein:

each of the first to third resistance ladder circuits is formed of the first to P-th resistance circuits (P is a positive integer); and in the second resistance ladder circuit, a ratio of a first resistance value of the L-th resistance circuit ($1 \leqq L \leqq P$, L is an integer) when driving a first display panel to a second resistance value of the L-th resistance circuit when driving a second display panel is equal to or less than 2.

8. The reference voltage generation circuit as defined in claim 1, wherein:

each of the first to third resistance ladder circuits is formed of the first to P-th resistance circuits (P is a positive integer); and in the second resistance ladder circuit, a ratio of a first resistance value of the L-th resistance circuit ($1 \leqq L \leqq P$, L is an integer) when driving a first display panel to a second resistance value of the L-th resistance circuit when driving a second display panel is equal to or less than 2.

9. The reference voltage generation circuit as defined in claim 1, wherein at least one of the variable resistance circuits of the first and third resistance ladder circuits includes series-connected resistance switch circuits, each of the resistance switch circuits having a resistance element and a switch element connected to each other in parallel.

10. The reference voltage generation circuit as defined in claim 9, wherein:

each of the first to third resistance ladder circuits is formed of the first to P-th resistance circuits (P is a positive integer); and in the second resistance ladder circuit, a ratio of a first resistance value of the L-th resistance circuit ($1 \leqq L \leqq P$, L is an integer) when driving a first display panel to a second resistance value of the L-th resistance circuit when driving a second display panel is equal to or less than 2.

11. The reference voltage generation circuit as defined in claim 1, wherein the variable resistance circuit in at least one of the first and third resistance ladder circuits includes:

a resistance element inserted between the i-th divided node (i is a positive integer) for generating the i-th reference voltage and the (i−1)th divided node for outputting the (i−1)th reference voltage among first to R-th reference voltages ($1 \leqq i \leqq R$, R is an integer equal to or larger than 2);

a first operational amplifier circuit which is voltage-follower connected and an input of which is connected to the i-th divided node;

a first switch element inserted between an output node of the i-th reference voltage and an output of the first operational amplifier circuit; and a second switch element inserted between the output node of the i-th reference voltage and the i-th divided node, wherein the first switch element is in the ON state and the second switch element is in the OFF state during a former period in a given drive period, and the first switch element is in the OFF state and the second switch element is in the ON state during a latter period in the drive period; and wherein an operating current of the first operational amplifier circuit is limited or terminated in the latter period of the drive period.

12. The reference voltage generation circuit as defined in claim 11, wherein:

each of the first to third resistance ladder circuits is formed of the first to P-th resistance circuits (P is a positive integer); and in the second resistance ladder circuit, a ratio of a first resistance value of the L-th resistance circuit ($1 \leqq L \leqq P$, L is an integer) when driving a first display panel to a second resistance value of the L-th resistance circuit when driving a second display panel is equal to or less than 2.

13. The reference voltage generation circuit as defined in claim 11, further comprising:

a second operational amplifier circuit inserted between an output of the first operational amplifier circuit and an output node of the (i+1)th reference voltage, wherein the second operational amplifier circuit outputs a voltage obtained by applying a given offset voltage to the i-th reference voltage in the former period; and wherein an operating current of the second operational amplifier circuit is limited or terminated in the latter period of the drive period.

14. The reference voltage generation circuit as defined in claim 13, wherein:

each of the first to third resistance ladder circuits is formed of the first to P-th resistance circuits (P is a positive integer); and in the second resistance ladder circuit, a ratio of a first resistance value of the L-th resistance circuit ($1 \leqq L \leqq P$, L is an integer) when driving a first display panel to a second resistance value of the L-th resistance circuit when driving a second display panel is equal to or less than 2.

15. A method of generating multi-valued reference voltages for generating a gamma-corrected grayscale value based on grayscale data, the method comprising:

providing first to third resistance ladder circuits connected in series between first and second power supply lines to which first and second power supply voltages are respectively supplied;

fixing a resistance value of the second resistance ladder circuit; and variably controlling resistance values of resistance circuits forming the first and third resistance ladder circuits, according to a given command or a variable control signal.

* * * * *